US006980154B2

(12) United States Patent
Vance et al.

(10) Patent No.: US 6,980,154 B2
(45) Date of Patent: Dec. 27, 2005

(54) PLANAR INVERTED F ANTENNAS INCLUDING CURRENT NULLS BETWEEN FEED AND GROUND COUPLINGS AND RELATED COMMUNICATIONS DEVICES

(75) Inventors: Scott LaDell Vance, Cary, NC (US); Gerard Hayes, Wake Forest, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 89 days.

(21) Appl. No.: 10/692,045

(22) Filed: Oct. 23, 2003

(65) Prior Publication Data

US 2005/0088347 A1 Apr. 28, 2005

(51) Int. Cl.[7] ..... H01Q 1/38; H01Q 1/24
(52) U.S. Cl. ..... 343/700 MS; 343/702
(58) Field of Search ..... 343/700 MS, 702, 343/804, 850, 852, 857, 860

(56) References Cited

U.S. PATENT DOCUMENTS

| | | | | |
|---|---|---|---|---|
| 5,434,579 | A | 7/1995 | Kagoshima et al. | |
| 5,684,492 | A | 11/1997 | Kagoshima et al. | |
| 5,926,139 | A | 7/1999 | Korisch | |
| 6,166,694 | A | 12/2000 | Ying | |
| 6,229,487 | B1 | 5/2001 | Sadler et al. | |
| 6,535,170 | B2 * | 3/2003 | Sawamura et al. | 343/702 |
| 6,646,610 | B2 * | 11/2003 | Troelsen | 343/702 |
| 6,738,023 | B2 * | 5/2004 | Scott et al. | 343/700 MS |
| 2002/0003499 | A1 | 1/2002 | Kouam et al. | |
| 2002/0130816 | A1 * | 9/2002 | Boyle | 343/702 |
| 2003/0103010 | A1 * | 6/2003 | Boyle | 343/702 |
| 2005/0024273 | A1 * | 2/2005 | Hayes | 343/702 |

FOREIGN PATENT DOCUMENTS

| | | | | |
|---|---|---|---|---|
| DE | 201 14 387 U1 | 8/2001 | | H01Q 1/38 |
| EP | 0 777 295 A2 | 6/1997 | | |
| EP | 1 026 774 A2 | 1/2000 | | H01Q 1/24 |
| EP | 1 026 774 A3 | 1/2000 | | H01Q 9/24 |
| EP | 1 052 723 A2 | 5/2000 | | H01Q 9/04 |
| EP | 1 052 722 A2 | 11/2000 | | |
| EP | 1 154 518 A2 | 5/2001 | | H01Q 9/04 |
| EP | 1 168 495 A2 A2 | 1/2002 | | |
| JP | 10093332 | 4/1998 | | |
| JP | 2000068736 | 3/2000 | | |
| WO | WO 00/36700 | 6/2000 | | |
| WO | WO 01/33665 A1 | 5/2001 | | |
| WO | WO 02/054534 | 7/2002 | | H01Q 1/24 |

OTHER PUBLICATIONS

Patent Abstract of Japan, Publication No. 10093332 *Dual Resonance Inverted-F Shape Antenna*, 1 sheet, Publication Date Apr. 10, 1998.

(Continued)

*Primary Examiner*—Shih-Chao Chen
*Assistant Examiner*—Minh Dieu A
(74) *Attorney, Agent, or Firm*—Myers Bigel Sibley & Sajovec

(57) ABSTRACT

A planar inverted F antenna may be configured for operation at an operating frequency band, and the planar inverted F antenna may include first, second, and third antenna segments, a reference voltage coupling, and a feed coupling. The first and second antenna segments may be separated by at least approximately 3 mm, and the third antenna segment may couple the first and second antenna segments. The reference voltage and feed couplings may both be provided on the first antenna segment, and a current null may be present between the feed and reference voltage couplings at the operating frequency band. Related communications devices are also discussed.

58 Claims, 16 Drawing Sheets

OTHER PUBLICATIONS

Patent Abstract of Japan, Publication No. 2000068736 *Multi-Frequency Antenna*, 1 sheet, Publication Date Mar. 3, 2000.

Invitation to Pay Additional Fees corresponding to PCT/US2004/017475 mailed Oct. 8, 2004.

Salonen et al., "New Slot Configurations for Dual-Band Planar Inverted-F Antenna", *Microwave and Optical Technology Letters*, 28, 5 pp. 293-298 (Mar. 5, 2001.

Copy of International Search Report and Written Opinion for corresponding PCT/US2004/017475, mailing date Feb. 1, 2005.

Dou, Wei Ping et al., Novel Meandered Planar Inverted-F Antenna For Triple-Frequency Operation, Microwave and Optical Technology Letters, Oct. 5, 2000, pp. 58-60. vol. 27, No. 1, Singapore.

Ollikainen Jani et al., Internal Dual-Band Patch Antenna for Mobile Phones,Helsinki University of Technology, Finland, date unknown, but for examination purposes, the date is before Dec. 17, 2002, p. 364 (4 sheets).

Wong, Kin-Lu, Chapter One, Introduction and Overview, Planar Antennas for Wireless Communications, Jan. 2003, pp. 1-25, ISBN: 0-471-26611-6.

Sager et al. "A Novel Technique to Increase the Realized Efficiency of a Mobile Phone Antenna Placed Beside a Head-Phantom," IEEE 2003.

Chiu et al., *Compact duāl-band PIFA with multi-resonators*, Electronics Letters, vol. 38, No.12, 2 sheets, Jun. 6, 2002.

Patent Abstracts of Japan, vol. 1998, No. 09, Publication No. 10093331, *Microstrip Antenna System*, 1 sheet, Publication Date Oct. 4, 1998.

* cited by examiner

PLANAR INVERTED F ANTENNAS INCLUDING CURRENT NULLS BETWEEN FEED AND GROUND COUPLINGS AND RELATED COMMUNICATIONS DEVICES

FIELD OF THE INVENTION

The present invention relates to the field of antennas, and more particularly to planar inverted F antennas and related communications devices.

BACKGROUND

The size of wireless terminals has been decreasing with many contemporary wireless terminals being less than 11 centimeters in length. Correspondingly, there is increasing interest in small antennas that can be utilized as internally mounted antennas for wireless terminals. Inverted-F antennas, for example, may be well suited for use within the confines of wireless terminals, particularly wireless terminals undergoing miniaturization. Inverted-F antennas may provide small size, low cost, and mechanical robustness. Typically, conventional inverted-F antennas may include a conductive element that is maintained in a spaced apart relationship with a ground plane. Exemplary inverted-F antennas are described, for example, in U.S. Pat. Nos. 5,684,492 and 5,434,579, which are incorporated herein by reference in their entirety.

Furthermore, it may be desirable for a wireless terminal to operate within multiple frequency bands in order to utilize more than one communications system. For example, Global System for Mobile communication (GSM) is a digital mobile telephone system that typically operates at a low frequency band, such as between 880 MHz and 960 MHz. Digital Communications System (DCS) is a digital mobile telephone system that typically operates at high frequency bands, such as between 1710 MHz and 1880 MHz. In addition, global positioning systems (GPS) or Bluetooth systems may use frequencies of 1.575 or 2.4–2.48 GHz. The frequency bands allocated for mobile terminals in North America include 824–894 MHz for Advanced Mobile Phone Service (AMPS) and 1850–1990 MHz for Personal Communication Services (PCS). Other frequency bands are used in other jurisdictions. Accordingly, internal antennas are being provided for operation within multiple frequency bands.

FIG. 9 illustrates one example of a prior art PIFA (planar inverted "F" antenna) that uses a center signal fed planar antenna shape with capacitive coupling 10. Generally stated, the high band element has an end portion that typically capacitively couples to a closely spaced apart end portion of the low band element, which, in operation, may cause a larger portion of the antenna element to radiate. U.S. Pat. No. 6,229,487 describes similar configurations for wireless devices, the contents of which are hereby incorporated by reference as if recited in full herein. Unfortunately, the increase in the coupling between the two elements by this configuration may result in degradation in bandwidth at the low-band element. In addition, the parasitic element may dictate tight manufacturing tolerances for proper operation that may increase production costs.

Kin-Lu Wong, in *Planar Antennas for Wireless Communications*, Ch. 1, p. 4, (Wiley, January 2003), illustrates some potential radiating top patches for dual-frequency PIFAS. As shown, the PIFA in FIG. 1.2(g) has a plurality of bends, but the configuration is such that the capacitive coupling between the two branches (primary and secondary branches) may be relatively large.

Certain antenna configurations may be used to increase operating efficiency. One such configuration, for example, is discussed by Mads Sager et al. in "A Novel Technique To Increase The Realized Efficiency Of A Mobile Phone Antenna Placed Beside A Head-Phantom" (IEEE 2003), the disclosure of which is hereby incorporated herein by reference in its entirety. Sager et al. discloses a dual-band PIFA antenna mounted on the backside of a printed circuit board, and a parasitic radiator mounted on the front side of the printed circuit board. Despite the foregoing, there remains a need for alternative planar antennas.

SUMMARY

According to embodiments of the present invention, a planar inverted F antenna may be configured for operation at an operating frequency band. The planar inverted F antenna may include three antenna segments, a reference voltage coupling, and a feed coupling. The first and second antenna segments may be separated by at least approximately 3 mm, and the third antenna segment may couple the first and second antenna segments. The reference voltage and feed couplings may be provided on the first antenna segment, and a current null may be present between the feed and reference voltage couplings at the operating frequency band.

The feed and reference voltage couplings may be separated by at least approximately 15 mm, and the first and second antenna segments may be rectilinear and parallel. Moreover, the third antenna segment may be coupled to the first and second antenna segments at ends of the first and second antenna segments. In addition, the feed coupling may be spaced apart from the third antenna segment by a greater distance than the reference voltage coupling, and the first and the third antenna segments may define an angle of approximately 90 degrees.

The first antenna segment (including the feed and reference voltage couplings) may be longer than the second antenna segment. Moreover, the operating frequency band may be in the range of approximately 1700 MHz to 2500 MHz. In addition, a printed circuit board may include a reference voltage conductor and an antenna feed conductor, and the reference voltage coupling may be electrically coupled to the reference voltage conductor of the printed circuit board and the feed coupling may be electrically coupled to the antenna feed conductor. The reference voltage coupling may be electrically coupled to the reference voltage conductor through an electrical short or through a non-zero impedance. In addition, the operating frequency band may include a high-frequency band and a low-frequency band, the current null may be present between the feed and reference voltage couplings at the high-frequency band, and the current null may not be present between the feed and reference voltage couplings at the low-frequency band.

According to additional embodiments of the present invention, a planar inverted F antenna may include a conductive antenna element, a feed coupling on the conductive antenna element, and first and second reference voltage couplings on the conductive antenna element. In addition, an electrical distance between the feed coupling and either of the first and second reference voltage couplings may be greater than an electrical distance between the first and second reference voltage couplings.

More particularly, the planar inverted F antenna may be configured for operation at an operating frequency band, and a current null may be present on the conductive antenna element between the feed coupling and at least one of the reference voltage couplings at the operating frequency band. The operating frequency band, for example, can be in the range of approximately 1700 MHz to 2500 MHz. Moreover, the operating frequency band may include a high-frequency band, the planar inverted F antenna may be further configured for operation at a low-frequency band, and the current null may be present at the high-frequency band but not at the low-frequency band.

In addition, a printed circuit board may include a reference voltage conductor and an antenna feed conductor, the first and second reference voltage couplings may be electrically coupled to the reference voltage conductor of the printed circuit board, and the feed coupling may be electrically coupled to the antenna feed conductor. Moreover, at least one of the first and second reference voltage couplings may be electrically coupled to the reference voltage conductor through an electrical short or through a non-zero impedance. The feed coupling and at least one of the first and second reference voltage couplings may be separated by an electrical distance of at least approximately 15 mm, and/or the feed coupling may be spaced apart from at least one of the first and second reference voltage couplings by an electrical distance of at least approximately 10 mm.

In a particular embodiment, the conductive antenna element may include first, second, and third antenna segments. The first and second antenna segments may be spaced apart, and the third antenna segment may be coupled between the first and second antenna segments. Moreover, the feed coupling and the first and second reference voltage couplings may be on the first segment with the feed coupling being between the first and second reference voltage couplings. The conductive antenna element may further include a fourth antenna segment coupled to the first antenna segment, and the fourth antenna segment may be coupled to the first antenna segment adjacent the feed coupling.

In other embodiments, the antenna element may include an antenna base and first and second antenna segments. The feed coupling and the first and second reference voltage couplings may be provided on the antenna base. The first segment may extending from the antenna base adjacent the first reference voltage coupling, and the second antenna segment may extend from the antenna base adjacent the feed coupling.

According to still additional embodiments of the present invention, a communications device may include a transceiver and a planar inverted F antenna. The transceiver may be configured to transmit and/or receive radio communications at an operating frequency band, and the transceiver may provide a reference voltage and a transceiver feed. The planar inverted F antenna may be configured for operation at the operating frequency band, and the planar inverted F antenna may include first and second antenna segments wherein the first and second antenna segments are separated by at least approximately 3 mm. A third antenna segment may couple the first and second antenna segments, and reference voltage and feed couplings may be provided on the first antenna segment. The reference voltage coupling of the planar inverted F antenna may be coupled to the reference voltage of the transceiver, the feed coupling may be coupled to the transceiver feed, and a current null may be present between the feed and reference voltage couplings at the operating frequency band.

According to yet additional embodiments of the present invention, a communications device may include a transceiver and a planar inverted F antenna. The transceiver may be configured to transmit and/or receive radio communications at an operating frequency band, and the transceiver may provide a reference voltage and a transceiver feed. The planar inverted F antenna may include a conductive antenna element and a feed coupling on the conductive antenna element wherein the feed coupling is coupled to the transceiver feed. The antenna may also include first and second reference voltage couplings on the conductive antenna element wherein the first and second reference voltage couplings are coupled to the reference voltage of the transceiver. In addition, an electrical distance between the feed coupling and either of the first and second reference voltage couplings may be greater than an electrical distance between the first and second reference voltage couplings.

DETAILED DESCRIPTION

Figure 1A:
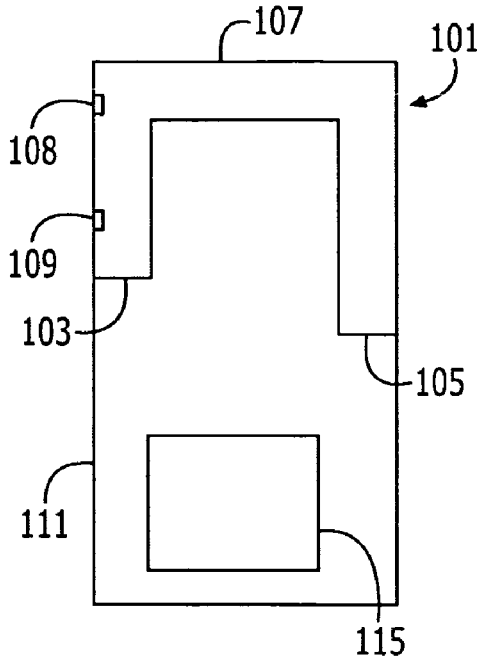
FIGS. 1*a–c* are plan, top, and side views of a planar inverted F antenna (PIFA) according to first embodiments of the present invention.

The present invention will now be described more fully hereinafter with reference to the accompanying drawings, in which embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the dimensions of various elements may be exaggerated for clarity. It will also be understood that when an element is referred to as being "coupled" or "connected" to another element, it can be directly coupled or connected to the other element, or intervening elements may also be present. Similarly, when an element is referred to as being "on" another element, it can be directly on the other element, or intervening elements may also be present. Like numbers refer to like elements throughout. This disclosure also uses relative terms, such as "side", "front", "back", "top", and/or "bottom" to describe some of the elements in the embodiments. These relative terms are used for the sake of convenience and clarity when referring to the drawings, but are not to be construed to mean that the elements so described can only be positioned relative to one another as shown.

Figure 1B:
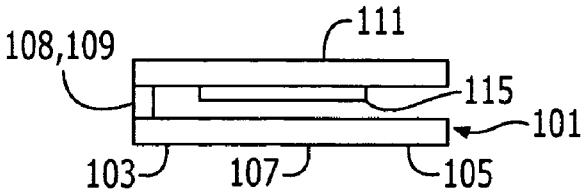
Figure 1C:
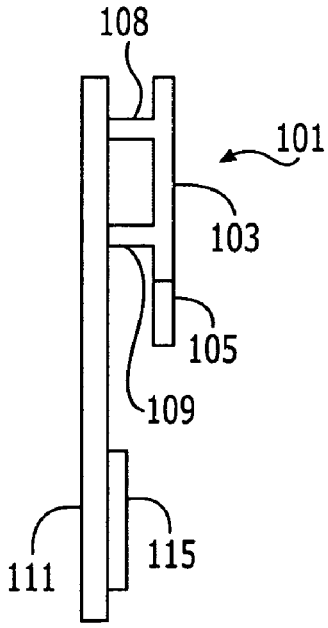

A planar inverted F antenna according to embodiments of the present invention is illustrated in FIGS. 1*a–c*. As shown, the planar inverted F antenna 101 may include a first antenna segment 103, a second antenna segment 105, a third antenna segment 107, a reference voltage coupling 108, and a feed coupling 109. More particularly, the first and second antenna segments 103 and 105 are separated by at least approximately 3 mm, and the third antenna segment 107 is coupled between the first and second antenna segments 103 and 105. Moreover, the reference voltage coupling 108 and the feed coupling 109 are on the first antenna segment 103. In addition, the planar inverted F antenna 101 may be configured for operation at one or more operating frequency bands, and a current null may be present between the reference voltage and feed couplings 108 and 109 at an operating frequency band. More particularly, the reference voltage and feed couplings 108 and 109 on the PIFA antenna 101 may be separated by at least approximately 15 mm.

According to particular embodiments of the present invention, the first antenna segment 103 may be 40 mm long and 7 mm wide, the second antenna segment 105 may be 50 mm long and 7 mm wide, and the first and second antenna segments 103 and 105 may be separated by 26 mm. Moreover, the third antenna segment 107 may be 26 mm long, between the first and second antenna segments 103 and 105, and the third antenna segment may be 15 mm wide.

As further shown in FIGS. 1*a–c*, the planar inverted F antenna 101 may be coupled to a printed circuit board 111 through the reference voltage and feed couplings 108 and 109. More particularly, a transceiver 115 may be provided as one or a plurality of integrated and/or discrete electronic devices on the printed circuit board 111. The transceiver 115 may be configured to transmit and/or receive radio communications at the operating frequency band(s), and the transceiver may provide a reference voltage and a transceiver feed. Conductive portions of the printed circuit board 111 provide an electrical coupling between the reference voltage coupling 108 of the planar inverted F antenna and the reference voltage of the transceiver 115.

More particularly, a conductive layer within the printed circuit board 111 may provide a reference voltage conductor (such as a ground plane), and the reference voltage coupling 108 of the planar inverted F antenna and the reference voltage of the transceiver may both be coupled to the reference voltage conductor of the printed circuit board 111. Additional conductive portions of the printed circuit board 111 may provide a feed conductor between the feed coupling 109 of the planar inverted F antenna and the transceiver feed. While the transceiver 115 is illustrated on the printed circuit board 111, portions or all of the transceiver 115 may be located remote from the printed circuit board 111 (such as on other printed circuit boards) and electrically coupled to the printed circuit board 111. Moreover, additional electronic devices (other than the transceiver 115) may be provided on the printed circuit board 111.

In addition, the reference voltage coupling 108 of the PIFA antenna 101 can be electrically coupled to the reference voltage conductor of the printed circuit board 111 through an electrical short. In an alternative embodiment, the reference voltage coupling 108 of the PIFA antenna 101 may be electrically coupled to the reference voltage conductor of the printed circuit board 111 through a non-zero impedance element such as a capacitance, inductance, and/or resistance. For example, an impedance element can be provided as a discrete impedance element(s) soldered to the printed circuit board and electrically connected between the reference voltage coupling 108 of the PIFA antenna 101 and the reference voltage conductor of the printed circuit board 111. Accordingly, one or more impedance elements can be used to tune the PIFA antenna 101.

In an alternative embodiment, a geometry of the reference voltage coupling 108 and/or a conductive layer on the printed circuit board may provide an impedance element. In yet another alternative embodiment, an impedance element may be provided between the reference voltage conductor of the printed circuit board and the reference voltage of the transceiver 115. In addition or in an alternative, the PIFA antenna 101 may be tuned by providing an impedance element(s) between the feed coupling 109 of the PIFA antenna 101 and the transceiver feed.

As shown in FIGS. 1*a–c*, the first and second antenna segments 103 and 105 may be rectilinear and parallel. Moreover, the third antenna segment 107 is coupled to the first and second antenna segments 103 and 105 at ends of the first and second antenna segments. In addition, the feed coupling 109 is spaced apart from the third antenna segment 107 by a greater distance than the reference voltage coupling 108, and the first and the third antenna segments 103 and 105 define an angle of approximately 90 degrees. The first antenna segment 103 may also be longer than the second antenna segment 105.

For example, an operating frequency band of the PIFA antenna 201 may be in the range of approximately 1700 MHz to 2500 MHz. Moreover, the planar inverted F antenna 101 may be configured for communications operation at a high-frequency band and at a low-frequency band, and the current null may be present between the reference voltage and feed couplings 108 and 109 during communications operations at the high-frequency band. The current null, however, may not be present between the reference voltage and feed couplings 108 and 109 during communications operations at the low-frequency band. By way of example, the PIFA antenna 103 may be used in a mobile terminal providing wireless communications at a low-frequency band(s), such as a cell band (approximately 824 MHz to approximately 894 MHz), and providing wireless communications at a high-frequency band(s), such as a Personal Communications Services PCS band (approximately 1850 MHz to approximately 1990 MHz), a Universal Mobile Telecommunications System UMTS band (including frequencies from approximately 1900 MHz to approximately 2200 MHz), and/or a Bluetooth band (approximately 2400 MHz to approximately 2485 MHz). As discussed above, the current null may be present when communicating in the high-frequency PCS, UMTS, and/or Bluetooth bands, but not when communicating in the low-frequency cell band.

While only a single reference voltage coupling 108 is illustrated in FIGS. 1*a–c*, it will be understood that additional reference voltage couplings may be provided according to embodiments of the present invention. For example, a second reference voltage coupling may be provided on the first antenna segment 103 such that the feed coupling 109 is between the first and second reference voltage couplings. Moreover, an impedance element(s) (such as a capacitor, inductor, and/or resistor) and/or a switch(s) may be included in series between the reference voltage conductor of the printed circuit board 111 and one or both of the reference voltage couplings of the PIFA antenna. Additional antenna segments may also be included on the PIFA antenna of FIGS. 1*a–c*. For example, a fourth antenna segment may extend from the first antenna segment 103 adjacent the feed coupling 109 toward the second antenna segment 105.

Figure 2A:
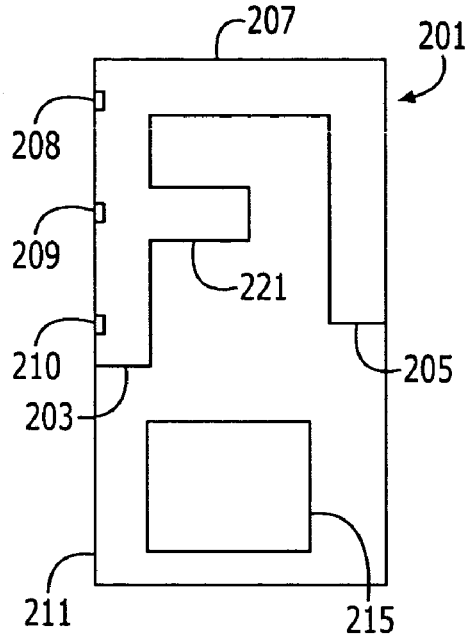
FIGS. 2*a–c* are plan, top, and side views of a planar inverted F antenna (PIFA) according to second embodiments of the present invention.
Figure 2B:
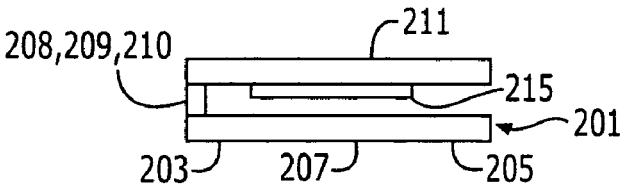
Figure 2C:
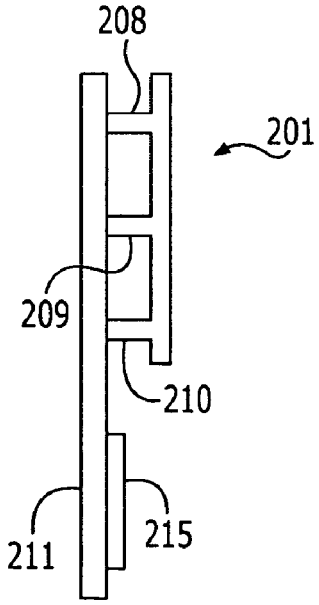

A planar inverted F antenna (PIFA) according to additional embodiments of the present invention is illustrated in FIGS. 2*a–c*. As shown in FIGS. 2*a–c*, the planar inverted F antenna 201 may include a feed coupling 209, and first and second reference voltage couplings 208 and 210. More particularly, an electrical distance between the feed coupling 209 and either of the first and second reference voltage couplings 208 an d 210 is greater than an electrical distance between the first and second reference voltage couplings 208 and 210. As used herein, the term electrical distance refers to the shortest path of electrical current between two points.

Moreover, the planar inverted F antenna 201 may be configured for operation at one or more operating frequency bands such that a current null is present on the planar inverted F antenna 201 between the feed coupling 209 and at least one of the reference voltage couplings 208 and 210 at an operating frequency band. According to particular embodiments of the present invention, current nulls may be present on the PIFA antenna between the feed coupling 209 and both of the reference voltage couplings 208 and 210.

As further shown in FIGS. 2*a–c*, the PIFA antenna 201 may include first, second, and third antenna segments 203, 205, and 207, with the first and second antenna segments being spaced apart and with the third antenna segment being coupled between the first and second antenna segments. Moreover, the feed coupling 209 and the first and second reference voltage couplings 208 and 210 may be provided on the first antenna segment 203. The PIFA antenna 201 may also include a fourth antenna segment 221 extending from the first antenna segment 203 adjacent the feed coupling 209 toward the second antenna segment 205.

According to particular embodiments of the present invention, the first antenna segment 203 may be 40 mm long and 7 mm wide, the second antenna segment 205 may be 50 mm long and 7 mm wide, and the first and second antenna segments 203 and 205 may be separated by 26 mm. Moreover, the third antenna segment 207 may be 26 mm long between the first and second antenna segments 203 and 205, and the third antenna segment may be 15 mm wide. In addition, the fourth antenna segment 221 may be 15 mm long and 7 mm wide.

As further shown in FIGS. 2*a–c*, the planar inverted F antenna 201 may be coupled to a printed circuit board 211 through the reference voltage couplings 208 and 210 and the feed coupling 209. More particularly, a transceiver 215 may be provided as one or a plurality of integrated and/or discrete electronic devices on the printed circuit board 211. The transceiver 215 may be configured to transmit and/or receive radio communications at the operating frequency band(s), and the transceiver may provide a reference voltage and a transceiver feed. Conductive portions of the printed circuit board 211 provide an electrical coupling between the reference voltage couplings 208 and 210 of the planar inverted F antenna and the reference voltage of the transceiver 215.

More particularly, a conductive layer within the printed circuit board 211 may provide a reference voltage conductor (such as a ground plane), and the reference voltage coupling 208 of the planar inverted F antenna and the reference voltage of the transceiver may both be coupled to the reference voltage conductor of the printed circuit board 211. Additional conductive portions of the printed circuit board 211 may provide a feed conductor between the feed coupling 209 of the planar inverted F antenna and the transceiver feed. While the transceiver 215 is illustrated on the printed circuit board 211, portions or all of the transceiver 215 may be located remote from the printed circuit board 211 (such as on other printed circuit boards) and electrically coupled to the printed circuit board 211. Moreover, additional electronic devices (other than the transceiver 215) may be provided on the printed circuit board 211.

In addition, each of the reference voltage couplings 208 and 210 of the PIFA antenna 201 can be electrically coupled to the reference voltage conductor of the printed circuit board 211 through an electrical short. In an alternative, one or both of the reference voltage couplings 208 and 210 of the PIFA antenna 201 may be electrically coupled to the reference voltage conductor of the printed circuit board 211 through an impedance element such as a capacitance, inductance, and/or resistance. For example, an impedance element(s) can be provided as a discrete impedance element(s) soldered to the printed circuit board and electrically connected between one or both of the reference voltage couplings 208 and 210 of the PIFA antenna 201 and the reference voltage conductor of the printed circuit board 211. Accordingly, one or more impedance elements can be used to tune the PIFA antenna 201.

In an alternative embodiment, a geometry of one or both of the reference voltage couplings 208 and 210 and/or a conductive layer on the printed circuit board may provide an impedance element. In yet another alternative embodiment, an impedance element may be provided between the reference voltage conductor of the printed circuit board and the reference voltage of the transceiver 215. In addition or in an alternative, the PIFA antenna 201 may be tuned by providing an impedance element(s) between the feed coupling 209 of the PIFA antenna 201 and the transceiver feed.

For example, an operating frequency band of the PIFA antenna 201 may be in the range of approximately 1700 MHz to 2500 MHz. Moreover, the planar inverted F antenna 201 may be configured for communications operation at a high-frequency band and at a low-frequency band, and the current null may be present between the feed coupling 209 and each of the reference voltage couplings 208 and 210 during communications operations at the high-frequency band. The current null, however, may not be present between the feed coupling 209 and either of the reference voltage couplings 208 and 210 during communications operations at the low-frequency band. By way of example, the PIFA antenna 201 may be used in a mobile terminal providing wireless communications at a low-frequency band(s), such as a cell band (approximately 824 MHz to approximately 894 MHz), and providing wireless communications at a high-frequency band(s), such as a Personal Communications Services PCS band (approximately 1850 MHz to approximately 1990 MHz), a Universal Mobile Telecommunications System UMTS band (including frequencies from approximately 1900 MHz to approximately 2200 MHz) and/or a Bluetooth band (approximately 2400 MHz to approximately 2485 MHz). As discussed above, the current null may be present when communicating in one or more of the high-frequency PCS, UMTS, and/or Bluetooth bands, but not when communicating in the low-frequency cell band.

Moreover, the feed coupling 209 and at least one of the first and second reference voltage couplings 208 and 210 may be separated by an electrical distance of at least approximately 15 mm. In addition, the feed coupling 209 may be spaced apart from each of the first and second reference voltage couplings by an electrical distance of at least approximately 8 mm.

Figure 3A:
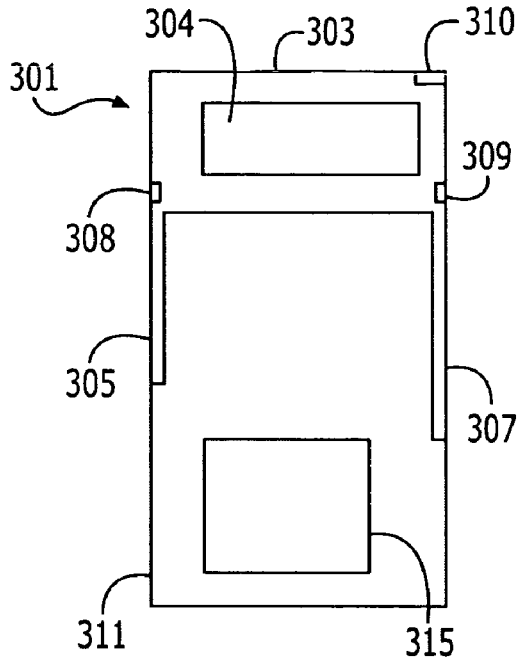
FIGS. 3*a–c* are plan, top, and side views of a planar inverted F antenna (PIFA) according to third embodiments of the present invention.
Figure 3B:
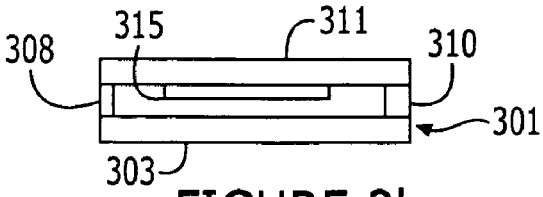
Figure 3C:
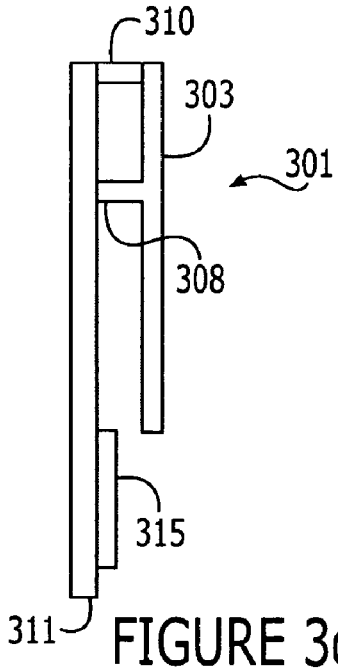

A planar inverted F antenna ("PIFA") according to yet additional embodiments of the present invention is illustrated in FIGS. 3*a–c*. As shown in FIGS. 3*a–c*, the PIFA antenna 301 may include a feed coupling 309, and first and second reference voltage couplings 308 and 310. More particularly, an electrical distance between the feed coupling 309 and either of the first and second reference voltage couplings 308 and 310 is less than an electrical distance between the first and second reference voltage couplings 308 and 310. Moreover, the planar inverted F antenna 301 may be configured for operation at an operating frequency band such that a current null is present on the PIFA antenna between the feed coupling 309 and at least one of the reference voltage couplings 308 and 310 at least one of the operating frequency bands. According to particular embodiments of the present invention, current nulls may be present on the PIFA antenna between the feed coupling 309 and one or both of the reference voltage couplings 308 and 310.

As further shown in FIGS. 3*a–c*, the PIFA antenna 301 may include an antenna base 303; a first rectilinear segment 305 extending from the antenna base 303 adjacent the reference voltage coupling 308; and a second rectilinear segment 307 extending from the antenna base 303 adjacent the feed coupling 309. More particularly, the antenna base 303 may be rectangular in shape with the feed coupling 309 and the first and second reference voltage couplings 308 and 310 being provided at different corners thereof. While the antenna base 303 is illustrated as having an opening 304 therein, the opening may not be required. As shown, the first rectilinear antenna segment 305 may be coupled to the antenna base 303 adjacent the reference voltage coupling 308, and the second rectilinear antenna segment 307 may be coupled to the antenna base 303 adjacent the feed coupling 309. Moreover, the first antenna segment 305 may be short relative to the second antenna segment 307.

According to particular embodiments of the present invention, the antenna base 303 may be 35 mm long (from the reference voltage coupling 308 to the feed coupling 309) and 8 mm wide (from the feed coupling 309 to the reference voltage coupling 310). The antenna segment 305 may be 16 mm long and 2 mm wide, and the antenna segment 307 may be 55 mm long and 2 mm wide. The first and second antenna segments 305 and 307 may be separated by 32 mm.

As further shown in FIGS. 3*a–c*, the planar inverted F antenna 301 may be coupled to a printed circuit board 311 through the reference voltage couplings 308 and 310 and the feed coupling 309. More particularly, a transceiver 315 may be provided as one or a plurality of integrated and/or discrete electronic devices on the printed circuit board 311. The transceiver 315 may be configured to transmit and/or receive radio communications at the operating frequency band(s), and the transceiver may provide a reference voltage and a transceiver feed. Conductive portions of the printed circuit board 311 provide an electrical coupling between the reference voltage couplings 308 and 310 of the planar inverted F antenna and the reference voltage of the transceiver 315.

More particularly, a conductive layer within the printed circuit board 311 may provide a reference voltage conductor (such as a ground plane), and the reference voltage coupling 308 of the planar inverted F antenna and the reference voltage of the transceiver may both be coupled to the reference voltage conductor of the printed circuit board 311. Additional conductive portions of the printed circuit board 311 may provide a feed conductor between the feed coupling 309 of the planar inverted F antenna and the transceiver feed. While the transceiver 315 is illustrated on the printed circuit board 311, portions or all of the transceiver 315 may be located remote from the printed circuit board 311 (such as on other printed circuit boards) and electrically coupled to the printed circuit board 311. Moreover, additional electronic devices (other than the transceiver 315) may be provided on the printed circuit board 311.

In addition, each of the reference voltage couplings 308 and 310 of the PIFA antenna 301 can be electrically coupled to the reference voltage conductor of the printed circuit board 311 through an electrical short. In an alternative embodiment, one or both of the reference voltage couplings 308 and 310 of the PIFA antenna 301 may be electrically coupled to the reference voltage conductor of the printed circuit board 311 through an impedance element such as a capacitance, inductance, and/or resistance. For example, an impedance element(s) can be provided as a discrete impedance element(s) soldered to the printed circuit board and electrically connected between one or both of the reference voltage couplings 308 and 310 of the PIFA antenna 301 and the reference voltage conductor of the printed circuit board 311. Accordingly, one or more impedance elements can be used to tune the PIFA antenna 301.

In an alternative embodiment, a geometry of one or both of the reference voltage couplings 308 and 310 and/or a conductive layer on the printed circuit board may provide an impedance element. In yet another alternative embodiment, an impedance element may be provided between the reference voltage conductor of the printed circuit board and the reference voltage of the transceiver 315. In addition or in an alternative, the PIFA antenna 301 may be tuned by providing an impedance element(s) between the feed coupling 309 of the PIFA antenna 301 and the transceiver feed. For example, reference voltage coupling 310 may be capacitively coupled to the reference voltage conductor of the printed circuit board to increase bandwidth at high band operating frequencies.

For example, an operating frequency band of the PIFA antenna 301 may be in the range of approximately 1700 MHz to 2500 MHs. Moreover, the planar inverted F antenna 301 may be configured for communications operation at a high-frequency band and at a low-frequency band, and the current null may be present between the feed coupling 309 and one or more of the reference voltage couplings 308 and 310 during communications operations at the high-frequency band. According to some embodiments, the current null may be present between the feed coupling 309 and the reference voltage coupling 308 (but not between the feed coupling 309 and the reference voltage coupling 310) during communications at the high-frequency band. The current null, however, may not be present between the feed coupling 309 and either of the reference voltage couplings 308 and 310 during communications operations at the low-frequency band. By way of example, the PIFA antenna 301 may be used in a mobile terminal providing wireless communications at a low-frequency band(s), such as a cell band (approximately 824 MHz to approximately 894 MHz), and providing wireless communications at a high-frequency band(s), such as a Personal Communications Services PCS band (approximately 1850 MHz to approximately 1990 MHz), a Universal Mobile Telecommunications System UMTS band (including frequencies from approximately 1900 MHz to approximately 2200 MHz), and/or a Bluetooth band (approximately 2400 MHz to approximately 2485 MHz). As discussed above, the current null may be present when communicating in one or more of the high-frequency PCS, UMTS, and/or Bluetooth bands, but not when communicating in the low-frequency cell band.

Moreover, the feed coupling 309 and at least one of the first and second reference voltage couplings 308 and 310 may be separated by an electrical distance of at least approximately 15 mm. In addition, the feed coupling 309 may be spaced apart from the first reference voltage coupling 308 by an electrical distance of at least approximately 10 mm.

A multi-band monopole antenna may require significant separation from a ground plane of the communication device. A planar inverted F antenna (PIFA) structure may have approximately 10% to 15% bandwidth at high-frequency bands (i.e. greater than approximately 1700 MHz). A PIFA antenna may provide advantages that a PIFA antenna can be internal to the body of the phone and/or that radiation from a PIFA antenna can be substantially directed away from the user when being held to the user's ear.

A PIFA antenna structure with separated feed and ground couplings may provide an advantage that peak currents on the printed circuit board (PCB) can be spread and the resulting peak radiation levels can be reduced. Many PIFA antennas in use today have separation of feed and ground couplings on the order of 2–8 mm. Desirable characteristics of an antenna for a mobile telephone may include: internal to the housing of the mobile telephone which may reduce breakage and/or lower cost; small in size thereby allowing for small overall phone size; high in efficiency and/or gain; directional away from the user when in use; not easily de-tuned by the user placing his/her finger/hand over the antenna; and predominantly vertically polarized when the mobile telephone is in the upright position.

In many internal PIFA antennas, the antenna feed coupling may be placed next to the ground coupling with a spacing of approximately 3 mm to 6 mm therebetween. Such a PIFA antenna may be relatively directional and may provide relatively high gain. With a 3 mm to 6 mm spacing, however, the antenna may be detuned relatively easily such as when a finger/hand is placed on the housing of the mobile telephone over the antenna. When detuned, a Voltage Standing Wave Ratio (VSWR) response mismatch may cause a multiple dB decrease in gain in addition to absorption loss by the user's finger/hand. Mobile telephones (such as Nokia models 3210 and 7210) may spread the feed and ground couplings further than 6 mm and may thereby obtain higher gain, a more directional pattern away from the user, and/or reduced sensitivity to detuning. In addition, coupling may be used to excite the low-band branch to resonate at high-band frequencies.

Figure 4A:
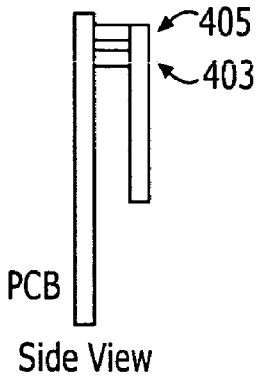
FIGS. 4*a* and 4*b* are side and plan views of a dual-band planar inverted F antenna (PIFA)
Figure 4B:
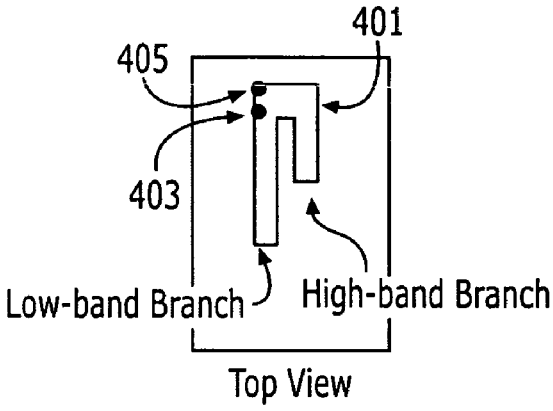
Figure 4C:
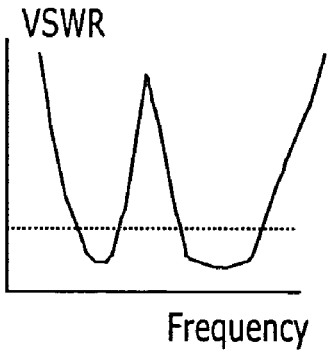
FIG. 4*c* is a corresponding graph of a voltage standing wave radio (VSWR) response for the planar inverted F antenna of FIGS. 4*a–b*.

Many PIFA antennas may act as ¼-wave radiators at both low and high-frequency bands. As shown in FIGS. 4*a–c*, these antennas may include a branched radiating element 401 that has an RF feed 403 with a ground coupling 405 that is placed in close proximity near one end of the radiating element 401. The PIFA antenna of FIGS. 4*a–c* may also include a low-band branch 407 and a high-band branch 409.

A PIFA antenna may act as a ¼-wave resonator at low-band and may have a high-band radiating structure that resembles the performance of a ½-wave radiator. A ½-wave performance may provide better gain and less performance degradation due to the presence of a user than a ¼-wave antenna.

When the high-band branch 409 of PIFA antenna 401 is lengthened to ½-wave (or longer), an impedance match may be degraded and the antenna may no longer be functional at relatively high-band frequencies (i.e. greater than 1700 MHz). High-band performance may be improved by fixing the ground coupling at the intersection of the two branches and separating the RF connection along the other antenna branch. As a result, the branch with the RF feed may provide a distributed impedance match to the high-band element. Two matching components (such as a series capacitor and shunt inductor or a series inductor and shunt capacitance) may be used to match to a high impedance antenna. By moving the RF feed, the matching components may not be needed. In addition, by controlling dimensions of the branch and location of the feed, additional bandwidth may be achievable.

According to embodiments of the present invention, a PIFA antenna may include at least two branches, and the radiating structure of the branch (or combination of branches) may be ½-wavelength (or longer) at some frequencies of operation. With orthogonal or widely separated branches, the coupling between the branches can be reduced. In addition, a ground coupling may be located at (or near) a junction of two branches, and this location of the ground coupling may establish a point of low-impedance and high radiating current at the junction between the branches. An RF feed coupling may be located away from the ground coupling along the other antenna branch. This displacement of feed and ground couplings may allow for better control of an impedance match of the PIFA antenna. For example, with the feed coupling located away from the far edge of the branch, additional bandwidth can be achieved. A portion of the branch that extends beyond the feed coupling may provide additional matching that can readily be tuned by controlling an area and/or length of the element.

According to additional embodiments of the present invention, the feed and ground couplings may be separated by a significant distance. In some PIFA antenna designs for the 1–2 GHz frequencies, spacing may be between 2 and 7 mm. In PIFA antennas according to some embodiments of the present invention, spacing between feed and ground couplings may be between about 20 mm and 40 mm or greater. The additional spacing according to some embodiments of the present invention may allow for creation of a current null at high-band frequencies, and may allow for additional bandwidth as the current flow of both the feed and ground couplings may be less than 90 degrees out of phase through a relatively large bandwidth (i.e. with current flowing up from the ground as it is flowing in from the feed). In some of the embodiments, a branch may be coupled between the feed and ground couplings to allow additional bandwidth to be achieved.

According to embodiments of the present invention, "detuning" resulting from placement of the user's finger over the PIFA antenna may bring the antenna closer to 50 Ohms, and may result in a Voltage Standing Wave Ratio (VSWR) response of better than 2:1 across multiple frequency 4 bands (i.e. the cell band at approximately 824 MHz to approximately 894 MHz; the PCS band at approximately 1850 MHz to approximately 1990 MHz; the UMTS band including frequencies from approximately 1900 MHz to approximately 2200 MHz; and/or the Bluetooth band at approximately 2400 MHz to approximately 2485 MHz), largely independent of where the finger is placed for the high-band(s).

Figure 7A:
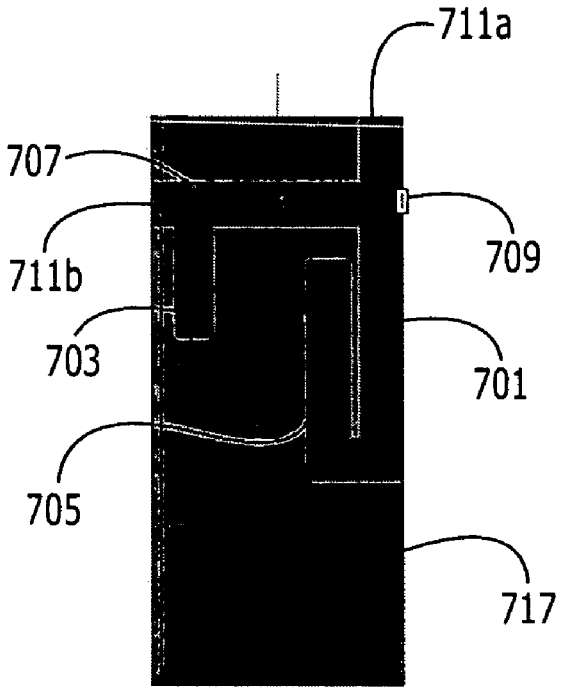
FIG. 7*a* is a plan view of a planar inverted F antenna (PIFA) according to yet additional embodiments of the present invention.
Figure 7B:
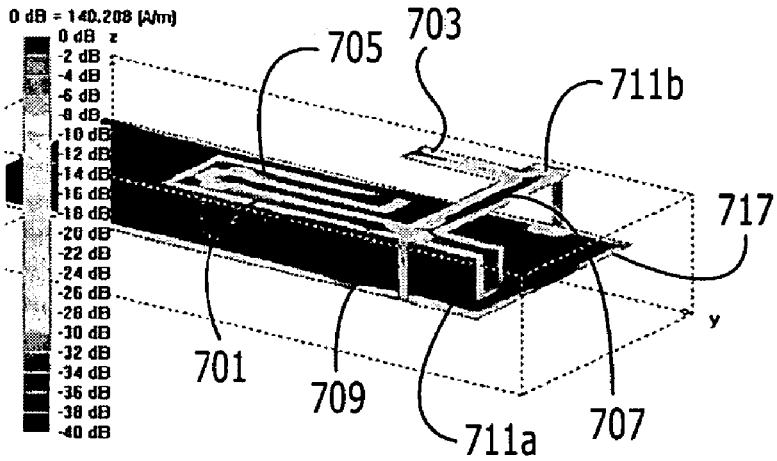
FIG. 7*b* is a perspective view of the planar inverted F antenna (PIFA) of FIG. 7*a* including simulated current densities at 1.7 GHz.
Figure 8A:
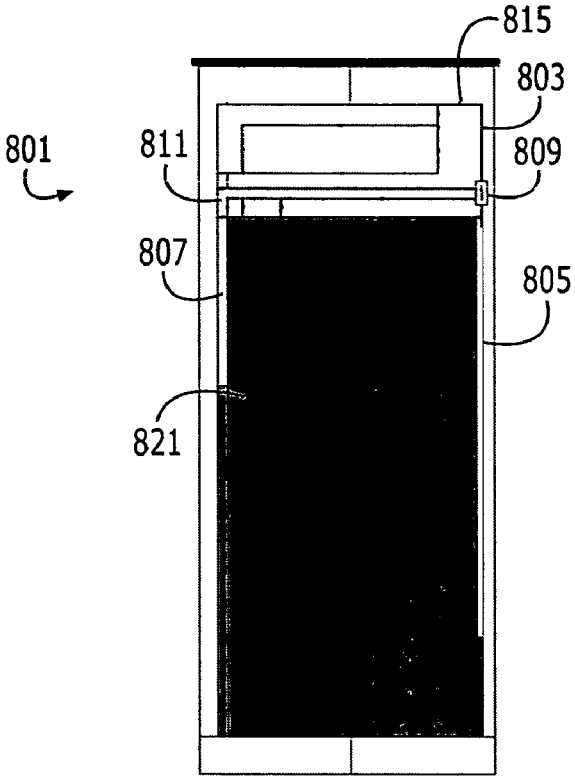
FIG. 8*a* is a plan view of a planar inverted F antenna (PIFA) according to more embodiments of the present invention.
Figure 8B:
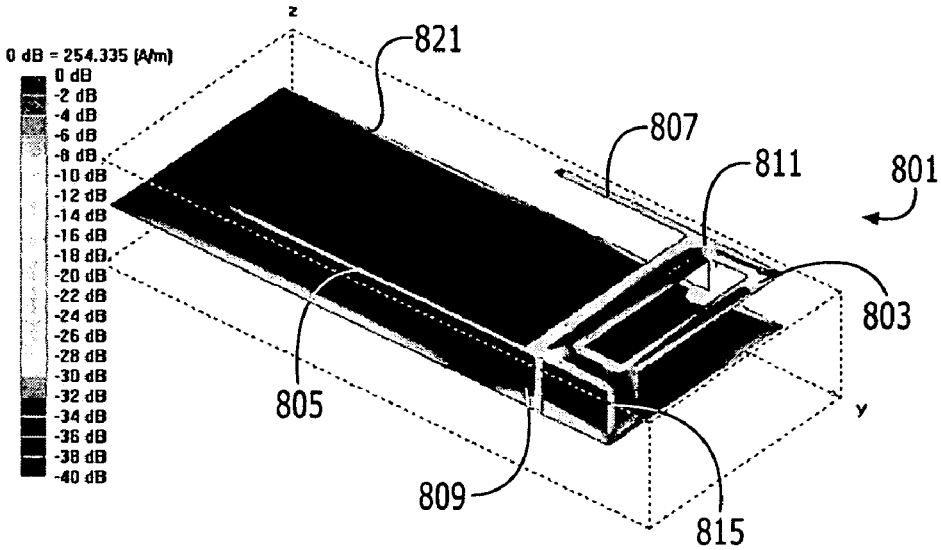
FIG. 8*b* is a perspective view of the planar inverted F antenna (PIFA) of FIG. 8*a* including simulated current densities at 1.8 GHz.

In additional embodiments of the present invention (such as illustrated in FIGS. 7*a–b*, for example), radiation toward a user can be reduced (4–6 dB lower than away from the user). In other embodiments (such as illustrated in FIGS. 8*a–b*, for example), gain may be more omni-directional. With separated feed and ground couplings, peak currents can be distributed over a greater area, thereby improving performance when placed near a user's head in an application such as a mobile radiotelephone. In still additional embodiments (such as illustrated in FIGS. 8*a–b*, for example), PIFA antenna elements can be shaped such that they can be located adjacent to a battery pack, etc., making a size reserved for the antenna similar to that of other products.

Figure 5A:
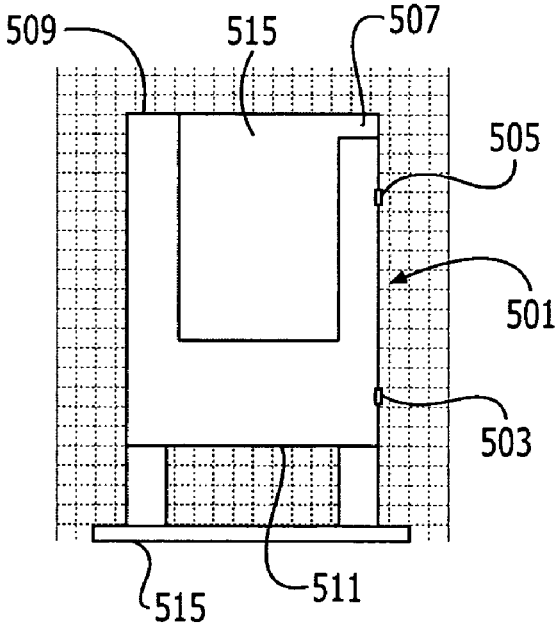
FIG. 5*a* is a plan view of a planar inverted F antenna (PIFA) according to additional embodiments of the present invention having dimensions of approximately 51.7 mm×36.5 mm×7 mm.
Figure 5B:
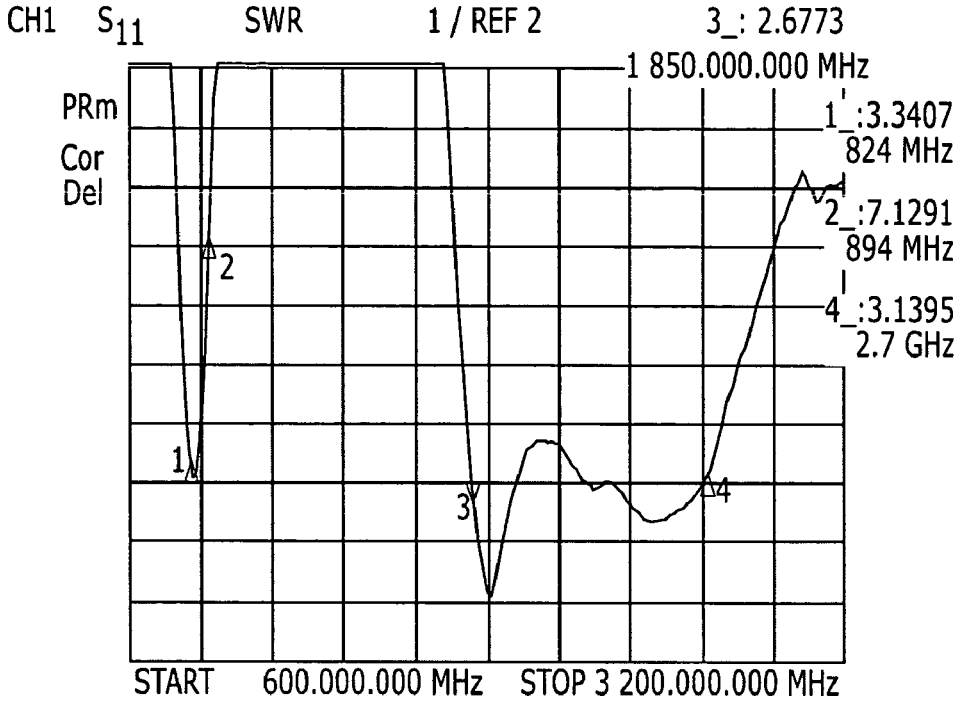
FIG. 5*b* is a graph illustrating simulated voltage standing wave ratio (VSWR) response of the planar inverted F antenna of FIG. 5*a* without a user finger and with markers at 824 MHz, 894 MHz, 1850 MHz, and 2700 MHz.
Figure 5C:
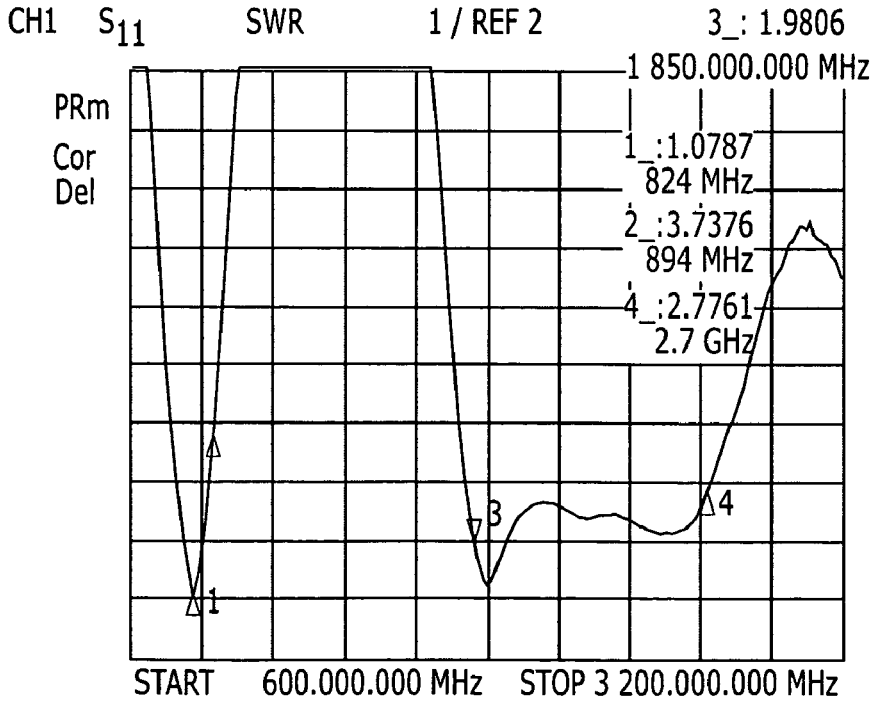
FIG. 5*c* is a graph illustrating simulated voltage standing wave ratio (VSWR) response of the planar inverted F antenna of FIG. 5*a* with a user finger proximate to the antenna and with markers at 824 MHz, 894 MHz, 1850 MHz, and 2700 MHz.

A multi-band PIFA antenna 501 according to embodiments of the present invention is illustrated in FIG. 5*a*, and simulated VSWR response and current distributions for the antenna of FIG. 5*a* are illustrated in FIGS. 5*b* and 5*c*, respectively. According to particular embodiments of the present invention, the PIFA antenna of FIG. 5*a* may have dimensions of approximately 51.7 mm by 36.5 mm by 7 mm. Moreover, the antenna 501 of FIG. 5*a* may include first segment 507 and second segment 509 with a third segment 511 therebetween. Moreover, the ground coupling 503 may be located adjacent the intersection of the first and third segments 507 and 511, and the ground coupling 503 may be centered relative to a width of the third segment 511. By fixing the ground coupling 503 adjacent the perpendicular intersection of the first segment 507 and the third segment 511 and by fixing the feed coupling on the first segment 507 as shown, significant separation of the feed and ground couplings may be provided without significantly impacting bandwidth and/or gain at low-frequency bands. The ground coupling 503 may be coupled to ground plane 515, and the ground plane 515 may extend further than illustrated in FIG. 5*a*.

The graphs of FIGS. 5*b* and 5*c* illustrate simulated Voltage Standing Wave Ratio (VSWR) responses for the PIFA antenna 501 of FIG. 5*a* with the PIFA antenna 501 separated from a printed circuit board by approximately 7 mm. FIG. 5*b* illustrates VSWR responses without the presence of a user's finger, and FIG. 5*c* illustrates VSWR responses with a user's finger on the PIFA antenna 501. Moreover, markers are placed on the graphs of FIGS. 5*b* and 5*c* at 824 MHz, 894 MHz, 1850 MHz, and 2700 MHz.

As seen in FIG. 5*b*, the sample structure may have a VSWR response of less than 5:1 for the cell band (824–894 MHz), and the sample structure may have a VSWR response of less than 4:1 for 1850–2700 MHz (which may include PCS, WCDMA, Bluetooth, and/or additional bandwidths). In addition, with user finger loading (which may be common when the user holds the phone), a VSWR response may be better than 2.5:1 for high-band frequencies (i.e. for frequencies greater than 1700 MHz). As a result, mismatch losses on the antenna may be less than 0.9 dB. This result may be similar to that of antennas covering only a single high-frequency band (for example, 1850 MHz to 1990 MHz providing approximately 7% bandwidth). Furthermore, currently used antennas for cell-phone applications may detune relatively easily when the user's finger is placed on the antenna, resulting in VSWR responses of 6:1 or greater. By using physically long high-band resonators in the PIFA antenna structure of FIG. 5*a*, detuning may be reduced and a VSWR response may be maintained below 3:1 for most of a high-frequency band. Accordingly, mismatch losses may be improved by as much as 2.5 dB or more over current designs.

As shown in FIG. 5*c*, there may be a current null between the ground and feed couplings 503 and 505. Because of this null and a resonance created on the low-band branch, a bandwidth at high-band of greater than 30% can be possible. Typical patch antennas and PIFA antennas may have a bandwidth of around 10% for a VSWR response of 4:1 or lower. Furthermore, by selectively removing the ground plane, even greater bandwidths can be achieved.

Figure 5D:
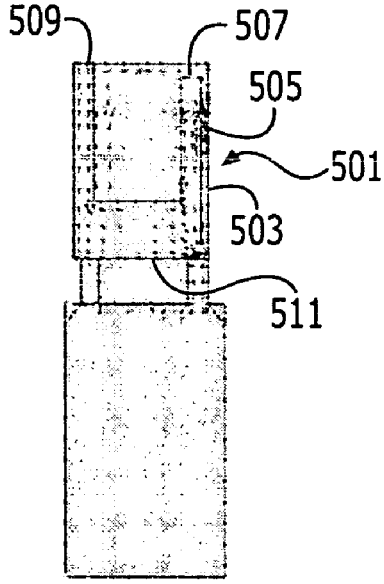
FIGS. 5*d* and 5*e* are simulated current patterns for the planar inverted F antenna of FIG. 5*a* at 2 GHz.
Figure 5E:
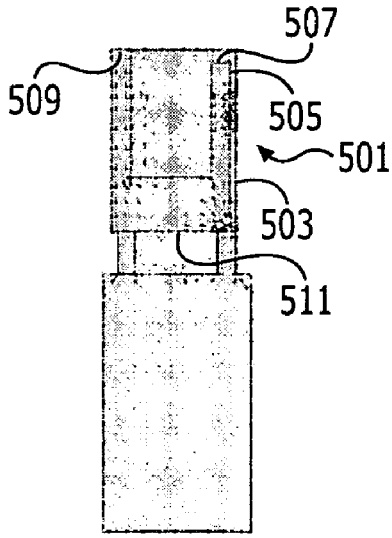

PIFA antennas according to embodiments of the present invention may be suitable, for example, for multi-band clamshell radiotelephones. More particularly, PIFA antennas according to embodiments of the present invention may be adapted for use for both low-frequency band(s) communications (for example, cellular band at approximately 824 MHz to approximately 894 MHz) and high-frequency band(s) communications (for example, PCS band at approximately 1850 MHz to approximately 1990 MHz, UMTS band including frequencies from approximately 1900 MHz to approximately 2200 MHz, and/or Bluetooth band at approximately 2400 MHz to approximately 2485 MHz). Moreover, by removing some of the ground plane near the top of the phone, the antenna of FIG. 5*a* can also be made to operate in other bands, including DCS (approximately 1710 MHz to approximately 1850 MHz). Other embodiments of the present invention may also be tuned to cover all of these bands as well. FIGS. 5*d* and 5*e* illustrate simulated current patterns for the PIFA antenna of FIG. 5*a* at 2 GHz.

Figure 5F:
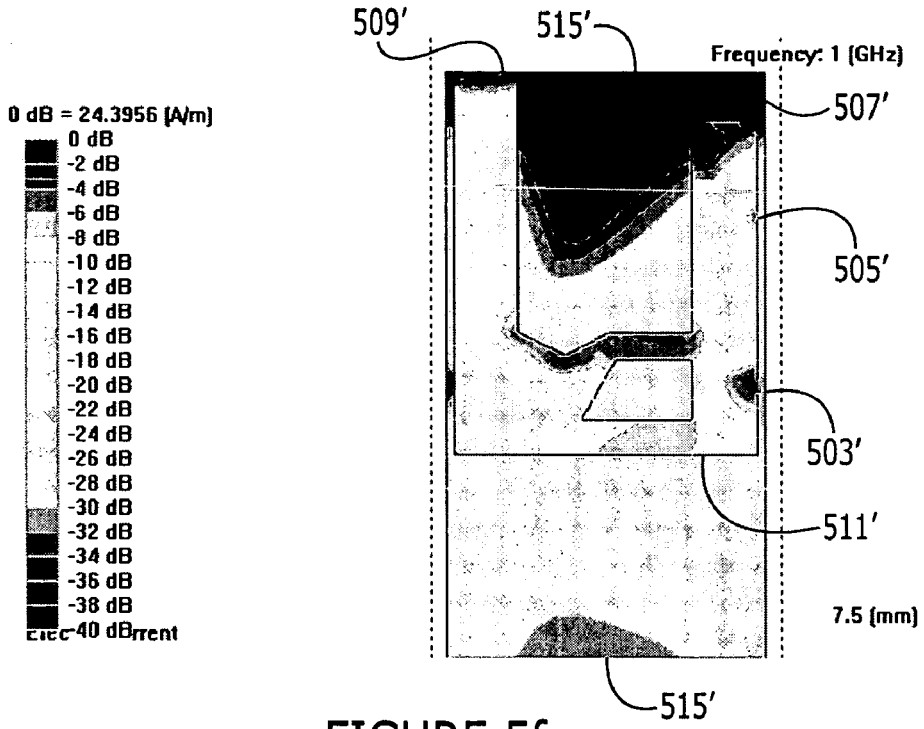
FIGS. 5*f* and 5*g* illustrate low-frequency (1 GHz) and high-frequency (2.5 GHz) band current densities (time averaged) for planar inverted F antennas according to embodiments of the present invention.
Figure 5G:
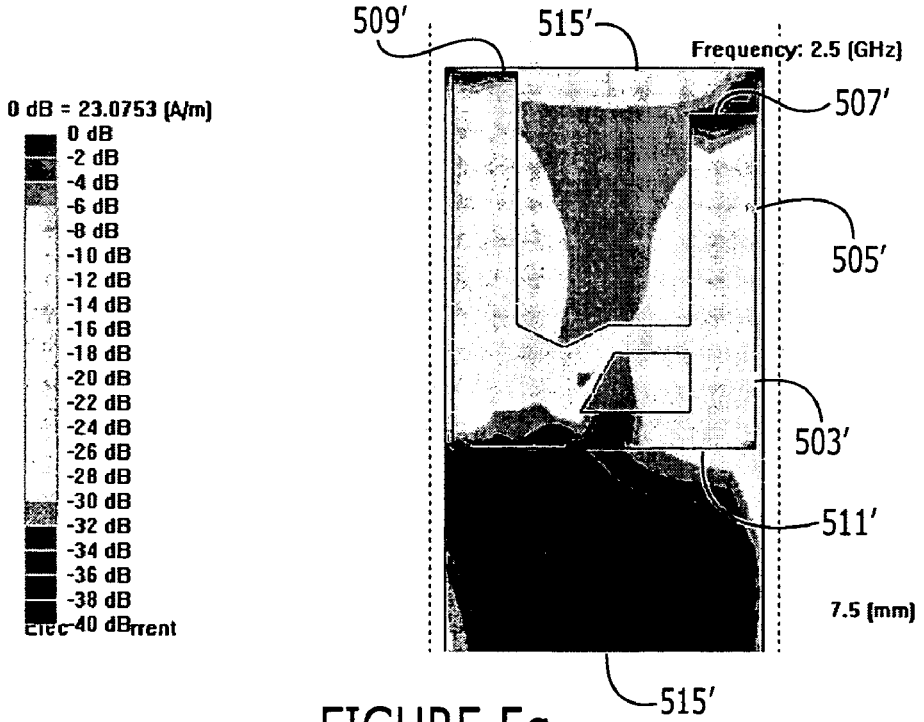

FIGS. 5*f* and 5*g* illustrate simulated current densities for a PIFA structure similar to that of FIG. 5*a*. As shown in FIGS. 5*f* and 5*g*, a PIFA antenna structure according to embodiments of the present invention may include a first antenna segment 507', a second antenna segment 509', a ground coupling 503', a feed coupling 505', and a third antenna segment 511' between the first and second antenna segments 507' and 509'. As shown in FIGS. 5*f* and 5*g*, the third antenna segment 511' may include an opening therein. The ground coupling 503' may be coupled to ground plane 515'. Simulated current densities for the PIFA antenna structure at 1 GHz are illustrated in FIG. 5*f*, and simulated current densities for the PIFA antenna structure at 2.5 GHz are illustrated in FIG. 5*g*. The ground plane 515' may extend further than illustrated in FIGS. 5*f* and 5*g*.

Figure 6A:
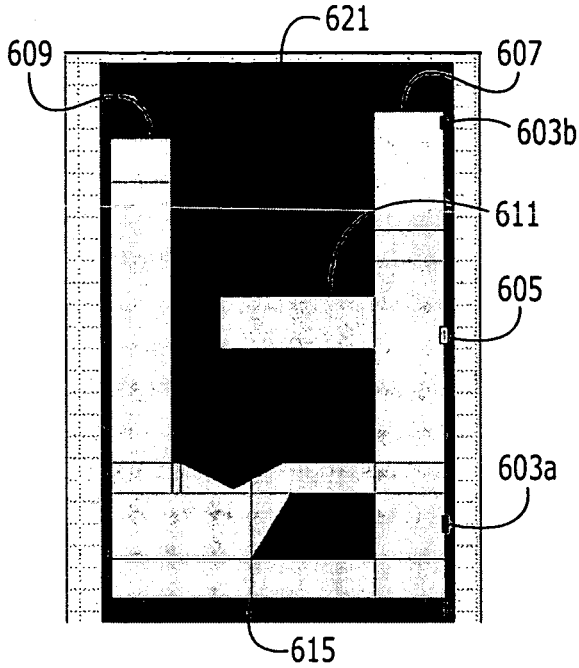
FIG. 6*a* is a plan view of a planar inverted F antenna (PIFA) according to still additional embodiments of the present invention.
Figure 6B:
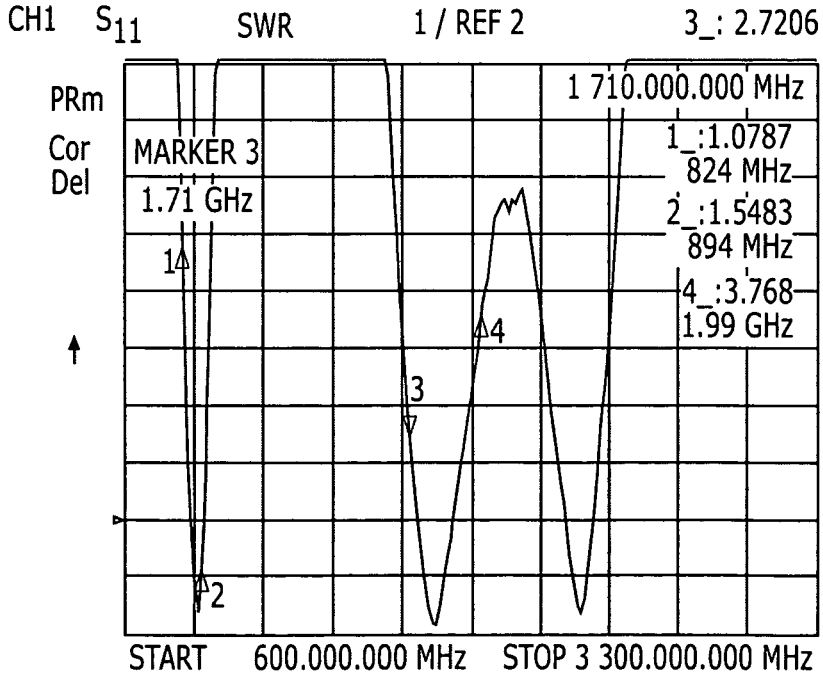
FIG. 6*b* is a graph illustrating simulated voltage standing wave ratio (VSWR) responses of the planar inverted F antenna of FIG. 6*a* with markers at 824 MHz, 894 MHz, 1710 MHz, and 1990 MHz.

In alternative embodiments of the present invention illustrated in FIG. 6*a*, a PIFA antenna may include a first antenna segment 607, a second antenna segment 609, a third antenna segment 611, first ground coupling 603*a*, second ground coupling 603*b*, and feed coupling 605. Moreover, the first and second antenna segments 607 and 609 may be coupled though a fourth antenna segment 615, and the feed coupling 605 may be provided on the first antenna segment 607 between the first and second ground couplings 603*a–b*. Moreover, the third antenna segment 611 may be provided adjacent to the feed coupling 605 with the feed coupling centered relative to a width of the third antenna element 611. Moreover, the fourth antenna segment 615 may have an opening therein. The first and second ground couplings 603*a–b* may be coupled to ground plane 621. As shown in FIG. 6*b*, a resulting low-frequency band resonance of the PIFA antenna of FIG. 6*a* may be narrower and deeper than that of the PIFA antenna illustrated in FIG. 5*a*. In addition, a DCS/PCS resonance of the PIFA antenna of FIG. 6*a* may be narrower and deeper than that of the PIFA antenna of FIG. 5*a*.

Figure 6C:
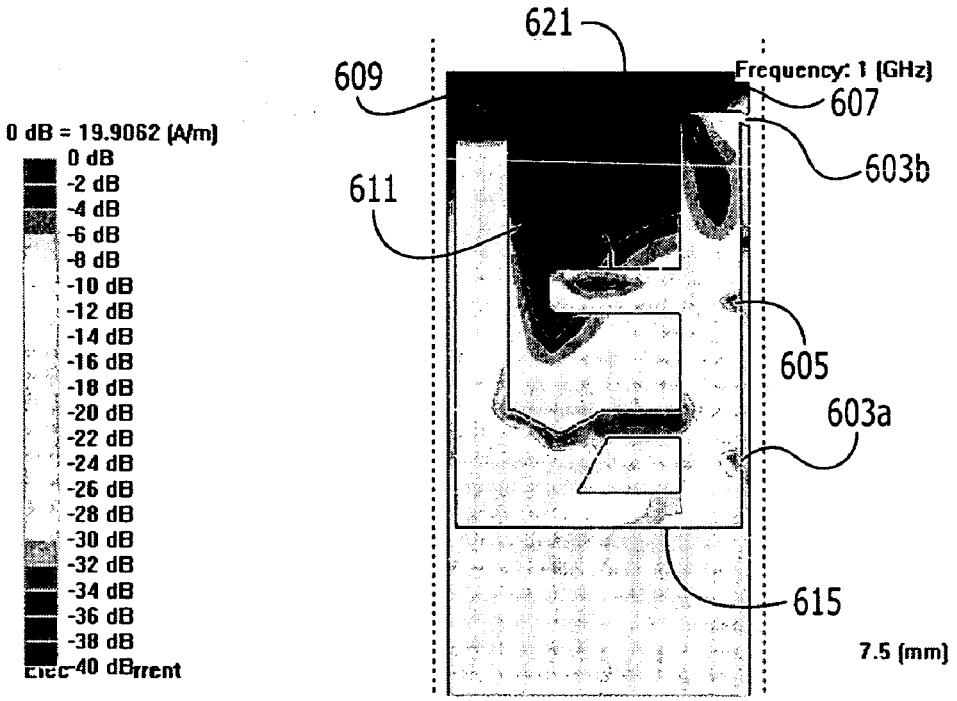
FIGS. 6*c–*6*g* are simulated current patterns of the PIFA antenna of FIG. 6*a* at 1 GHz, 2.2 GHz, 2.4 GHz, 2.6 GHz, and 2.7 GHz, respectively.
Figure 6D:
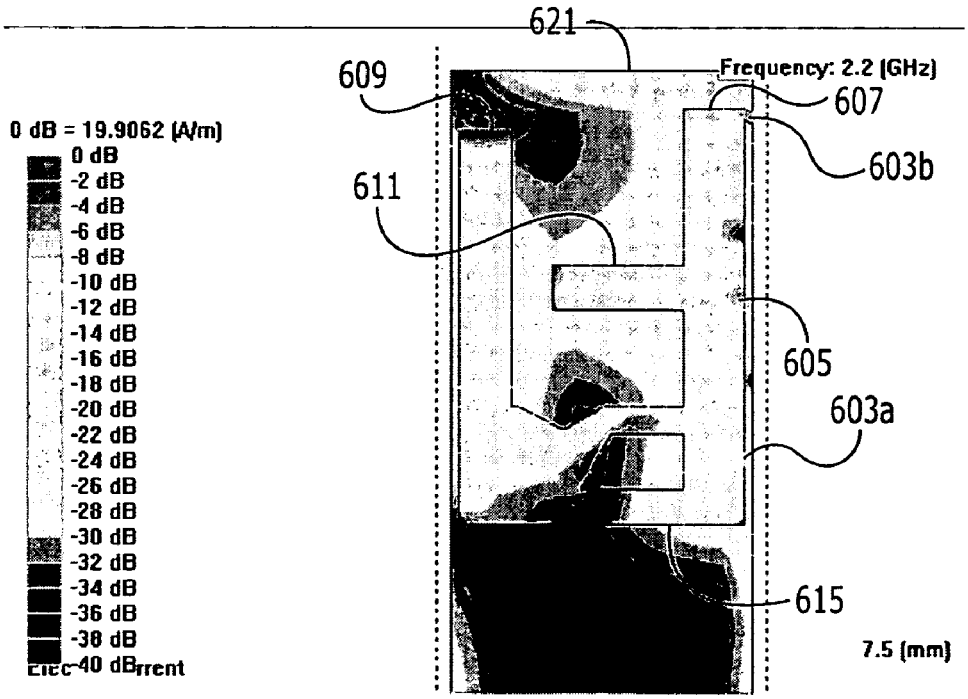
Figure 6E:
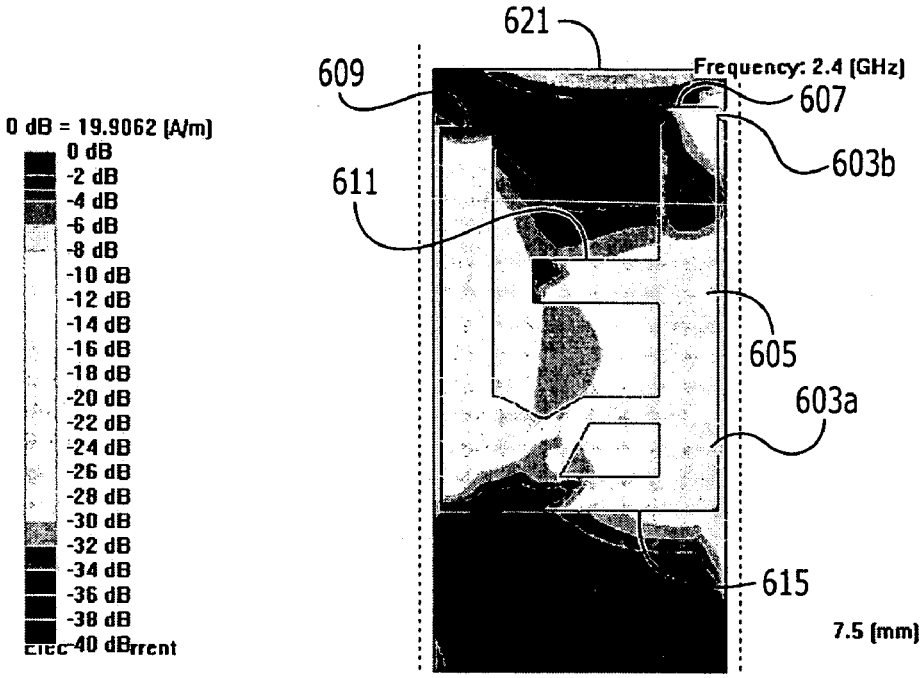
Figure 6F:
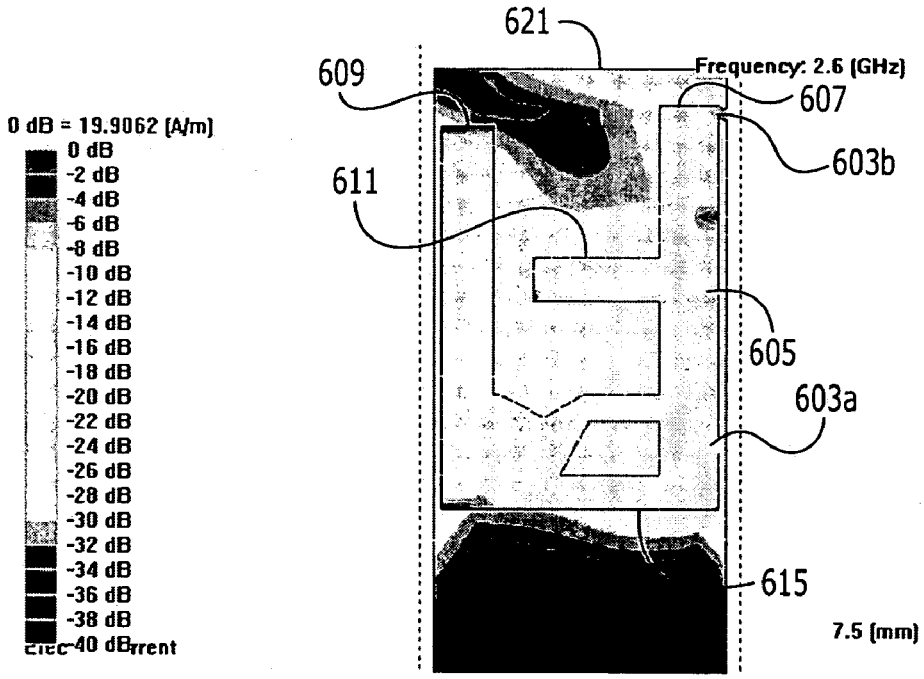
Figure 6G:
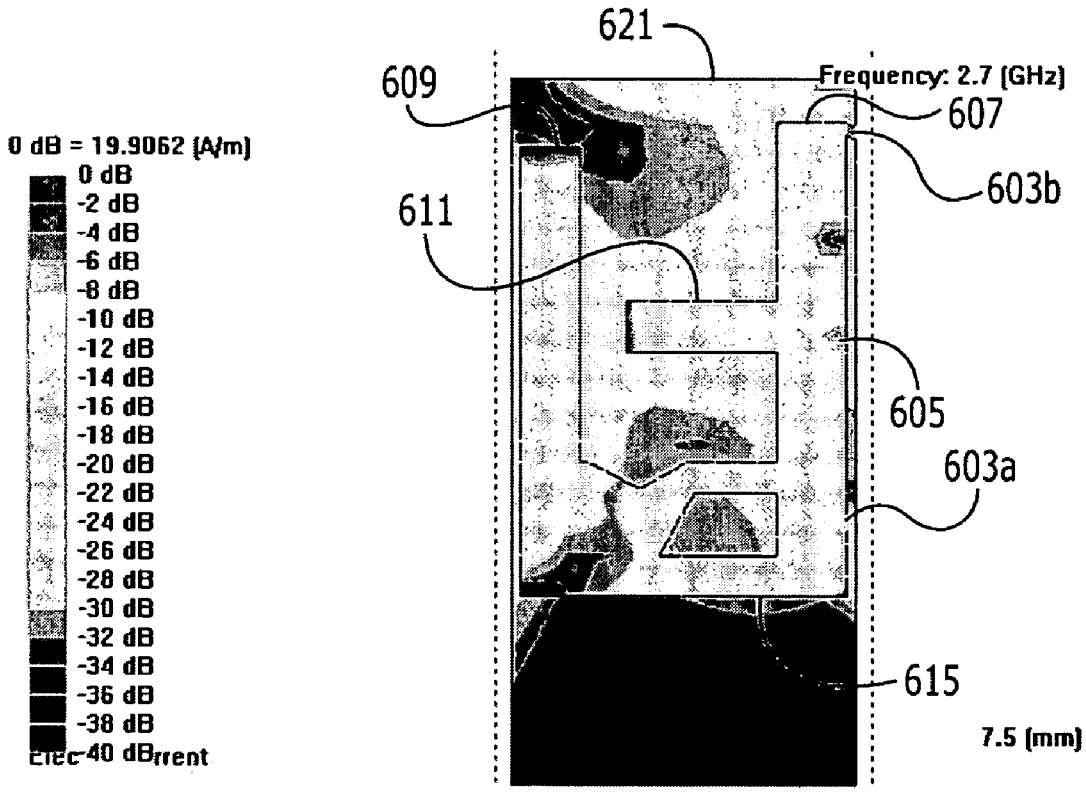

Simulated current densities are illustrated in FIGS. 6*c–g* for the PIFA antenna of FIG. 6*a*. FIG. 6*c* illustrates simulated current densities at 1 GHz, FIG. 6*d* illustrates simulated current densities at 2.2 GHz, FIG. 6*e* illustrates simulated current densities at 2.4 GHz, FIG. 6*f* illustrates simulated current densities at 2.6 GHz, and FIG. 6*g* illustrates simulated current densities at 2.7 GHz. The ground plane 621 illustrated in FIGS. 6*a* and 6*c–g* may extend further than illustrated.

According to additional embodiments of the present invention, the PIFA antenna of FIGS. 7*a–b*, a PIFA antenna may include first through fourth antenna segments 701, 703, 704, 705, and 707. The PIFA antenna of FIGS. 7*a–b* may also include a feed coupling 709 and ground couplings 711*a–b* to the printed circuit board 717. The PIFA antenna of FIGS. 7*a–b* is approximately 39 mm wide and 55 mm tall, and it is modeled as being 10 mm from the ground plane of the printed circuit board 717. Moreover, FIG. 7*b* provides simulated current densities at 1.7 GHz.

Figure 7C:
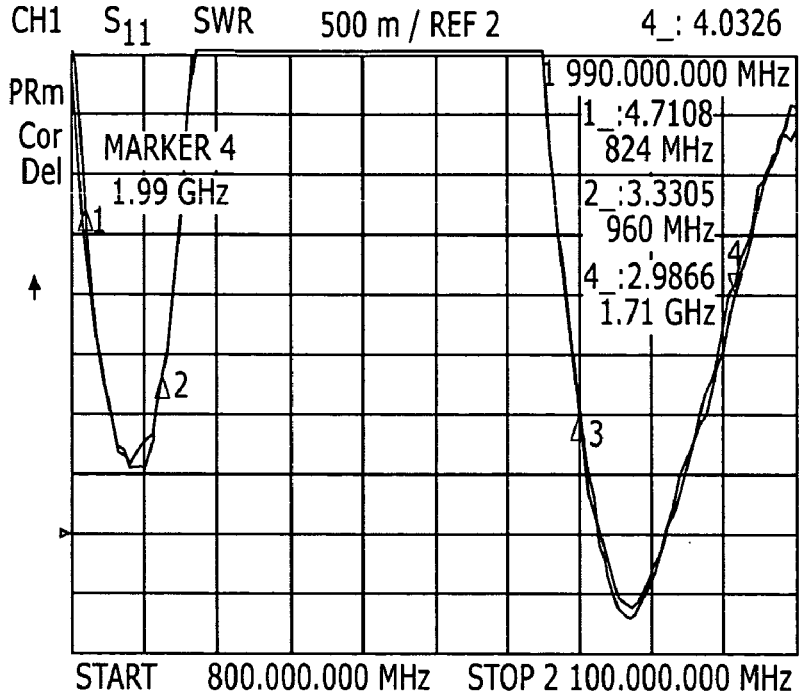
FIG. 7*c* is a graph illustrating simulated voltage standing wave ratio (VSWR) responses of the planar inverted F antenna (PIFA) of FIGS. 7*a–b* without a user finger and with low-frequency band markers at 824 MHz and 960 MHz and with high-frequency band markers at 1710 MHz and 1990 MHz.
Figure 7D:
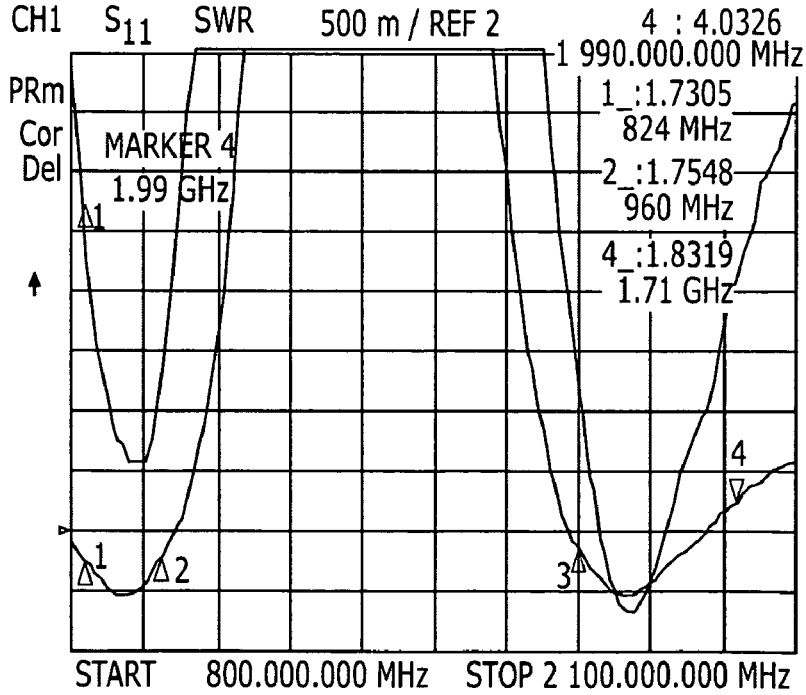
FIG. 7*d* is a graph illustrating simulated voltage standing wave ratio (VSWR) responses of the planar inverted F antenna (PIFA) of FIGS. 7*a–b* with a user finger proximate to the antenna and with low-frequency band markers at 824 MHz and 960 MHz and with high-frequency band markers at 1710 MHz and 1990 MHz.

The graph of FIG. 7*c* illustrates simulated voltage standing wave ratio (VSWR) responses for the PIFA antenna of FIGS. 7*a–b* without the presence of a user's finger. The graph of FIG. 7*d* illustrates simulated voltage standing wave ratio (VSWR) responses for the PIFA antenna of FIGS. 7*a–b* with a user's finger adjacent the antenna. Low-band frequency markers are provided at 824 MHz and 960 MHz. High-frequency band markers are provided at 1710 MHz and 1990 MHz.

Additional embodiments of the present invention are illustrated in FIGS. 8*a–d*. As shown in FIGS. 8*a–b*, a PIFA antenna 801 may include an antenna base 803, and first and second antenna segments 805 and 807. Moreover, the antenna base 803 may be rectangular with an opening therein, a feed coupling 809 may be located at a corner of the antenna base 803 adjacent the antenna segment 805, and a first ground coupling 811 may be located at a corner of the antenna base 803 adjacent the antenna segment 807. Moreover, a second ground coupling 815 may be located at a corner of the antenna base 803 opposite the first ground coupling 811.

Figure 8C:
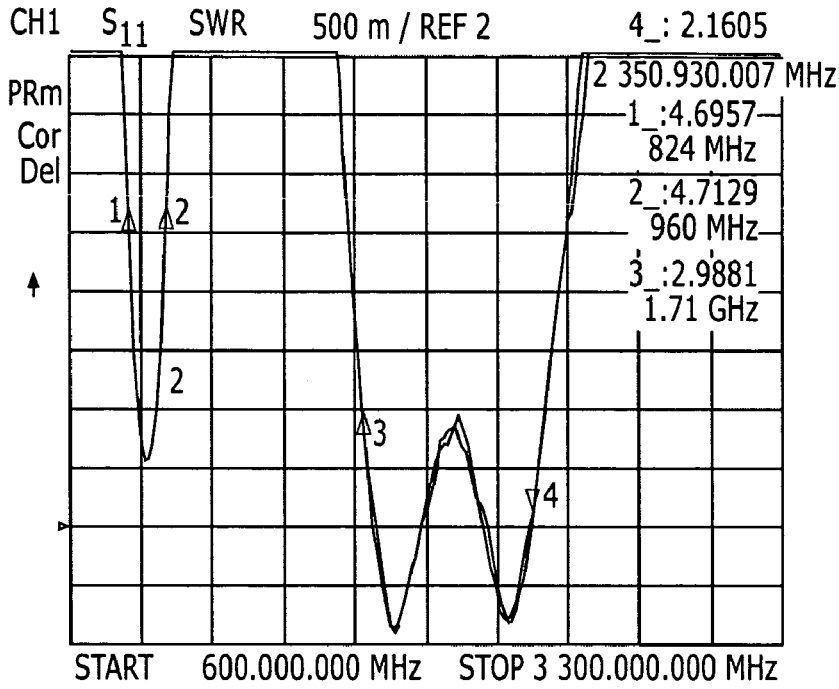
FIG. 8*c* is a graph illustrating simulated voltage standing wave ratio (VSWR) responses of the planar inverted F antenna (PIFA) of FIGS. 8*a–b* without a user finger and with low-frequency band markers at 824 MHz and 960 MHz and with high-frequency band markers at 1710 MHz and 2350 MHz.
Figure 8D:
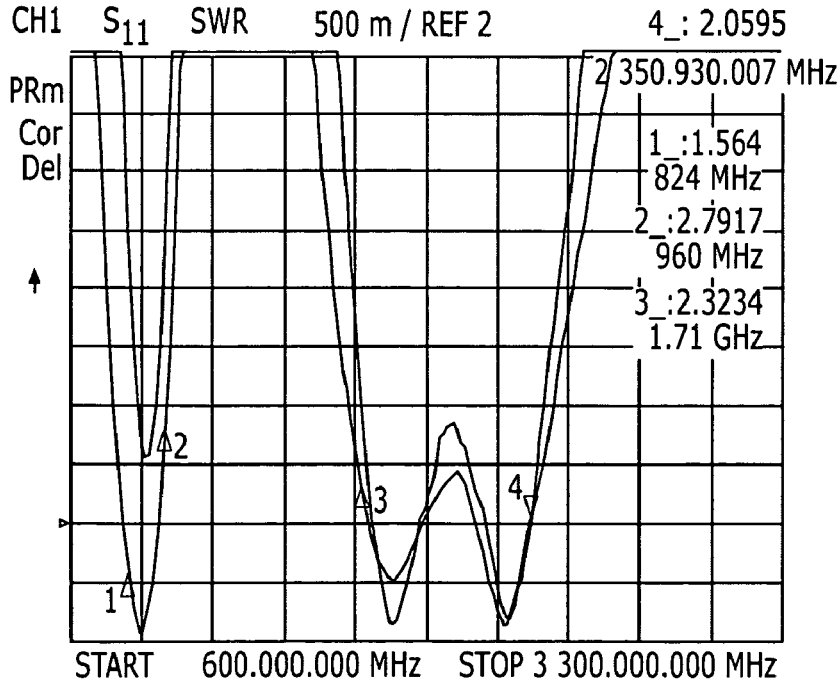
FIG. 8*d* is a graph illustrating simulated voltage standing wave ratio (VSWR) responses of the planar inverted F antenna (PIFA) of FIGS. 8*a–b* with a user finger proximate to the antenna and with low-frequency band markers at 824 MHz and 960 MHz and with high-frequency band markers at 1710 MHz and 2350 MHz.
Figure 9:
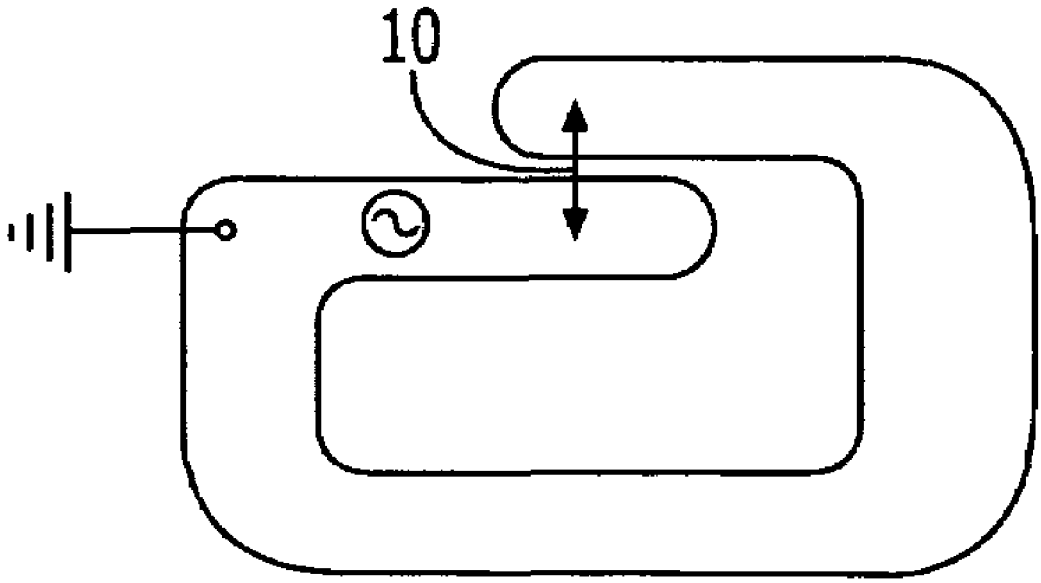
FIGURE 9 (PRIOR ART)
FIG. 9 illustrates one example of a prior art PIFA (planar inverted "F" antenna).

The antenna base 803 between the feed and ground couplings 809 and 811 may be relatively wide, but widths of the antenna segments 805 and 807 extending off of the feed and ground couplings 809 and 811 may be relatively narrow. As before, ground coupling 815 to the ground plane of the printed circuit board 821 can be used to obtain additional bandwidth. In physical models, wires with a diameter of about 0.8 mm can be used for the antenna segments 805 and 807 extending from the antenna base 803. According to particular embodiments, the antenna base 803 may be 40 mm long between the feed and ground couplings 809 and 811 and 16 mm wide. Moreover, the PIFA antenna 801 may be elevated approximately 10 mm off of a ground plane of the printed circuit board 821. In addition, a distance from the feed coupling 809 to the end of the long antenna segment 805 can be modeled at 72 mm. In FIG. 8*b*, current densities are simulated at 1.8 GHz. As shown in FIG. 8*b*, both low-frequency band and high-frequency band radiators may effectively radiate at high frequencies. Simulated voltage standing wave ratio (VSWR) responses for the PIFA antenna of FIGS. 8*a–b* without the presence of a user's finger are shown in the graph of FIG. 8*c*. Simulated voltage standing wave ratio (VSWR) responses for the PIFA antenna of FIGS. 8*a–b* with the presence of a user's finger are shown in the graph of FIG. 8*d*. In FIGS. 8*c* and 8*d*, low-frequency band markers are provided at 824 MHz and 960 MHz, and high-frequency band markers are provided at 1710 MHz and at 2350 MHz.

Of the PIFA antennas discussed above, the PIFA antennas of FIGS. 5*a* and 8*a* may provide the greatest bandwidth. Moreover, the PIFA antenna of FIG. 8*a* may be relatively easy to tune to a desired frequency band because of the relative independence (for tuning purposes) of the two branches which may extend from the feed and ground couplings.

According to embodiments of the present invention, a PIFA antenna may have at least two antenna segments with a ½-wave (or greater) resonance, and one of the segments may act as an impedance match to obtain a relativley broad bandwidth. With two orthogonal segments, dual-band performance may be readily obtained with a relatively broad high-band response. Additional grounding points may be added along the branch with the RF feed to obtain a better VSWR response. In addition, multiple segments can be added to either antenna segment to obtain additional frequency resonances at additional operating bands.

In a particular product, a PIFA antenna according to embodiments of the present invention can be loaded with plastic with a dielectric constant of approximately 2 so that a size of the antenna may be reduced. Additional loading (and size reduction) may also be caused by a battery. In general, gain may decrease, but bandwidth may improve. Slight variations in the pattern may be seen due to the addition of shield cans, etc, as well as the size of the ground plane. With a PIFA antenna according to FIGS. 7*a–b*, relatively high gain may be provided in a band of frequencies between 1710 MHz and 2.4 GHz, so that the antenna of FIGS. 7*a–b* may be especially suited for use in a multiple mode mobile radiotelephone operating in frequency bands for DCS, PCS, and WCDMA communications. A second resonance of the antenna may also be shifted so that BlueTooth frequencies (i.e. 2.4 GHz to 2.485 GHz) are also covered.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A planar inverted F antenna configured for operation at an operating frequency band, the planar inverted F antenna comprising:

first and second conductive antenna segments wherein the first and second conductive antenna segments are separated by at least approximately 3 mm;

a third conductive antenna segment coupling the first and second conductive antenna segments;

a reference voltage coupling on the first conductive antenna segment; and a feed coupling on the first conductive antenna segment, wherein a current null is present on the first conductive antenna segment between the feed and reference voltage couplings at the operating frequency band.

2. A planar inverted F antenna according to claim 1 wherein the feed and reference voltage couplings are separated by at least approximately 15 mm.

3. A planar inverted F antenna according to claim 1 wherein the first and second conductive antenna segments are rectilinear and parallel.

4. A planar inverted F antenna according to claim 3 wherein the third conductive antenna segment is coupled to the first and second conductive antenna segments at ends of the first and second conductive antenna segments.

5. A planar inverted F antenna according to claim 1 wherein the feed coupling is spaced apart from the third conductive antenna segment by a greater distance than the reference voltage coupling.

6. A planar inverted F antenna according to claim 5 wherein the first and the third conductive antenna segments define an angle of approximately 90 degrees.

7. A planar inverted F antenna according to claim 1 wherein the first conductive antenna segment is longer than the second conductive antenna segment.

8. A planar inverted F antenna according to claim 1 wherein the operating frequency band is in the range of approximately 1700 MHz to 2500 MHz and wherein the current null is present between the feed and reference voltage couplings at the operating frequency band in the range of approximately 1700 MHz to 2500 MHz.

9. A planar inverted F antenna according to claim 1 further comprising:

a printed circuit board including a reference voltage conductor and an antenna feed conductor, the reference voltage coupling being electrically coupled to the reference voltage conductor of the printed circuit board and the feed coupling being electrically coupled to the antenna feed conductor wherein the first, second, and third conductive antenna segments are spaced apart from the printed circuit board.

10. A planar inverted F antenna according to claim 9 wherein the reference voltage coupling is electrically coupled to the reference voltage conductor through an electrical short.

11. A planar inverted F antenna according to claim 9 wherein the reference voltage coupling is electrically coupled to the reference voltage conductor through a non-zero impedance.

12. A planar inverted F antenna according to claim 1 wherein the operating frequency band comprises a high-frequency band, wherein the planar inverted F antenna is further configured for operation at a low-frequency band, wherein the current null is present between the feed and reference voltage couplings at the high-frequency band, and wherein the current null is not present between the feed and reference voltage couplings at the low-frequency band.

13. A planar inverted F antenna according to claim 12 wherein the high-frequency band is above 1700 MHz and wherein the low-frequency band is below 1100 MHz.

14. A planar inverted F antenna according to claim 1 wherein the operating frequency band is above 1700 MHz and wherein the current null is present between the feed and reference voltage couplings at the operating frequency band above 1700 MHz.

15. A planar inverted F antenna comprising:

a conductive antenna element;

a feed coupling on the conductive antenna element; and first and second reference voltage couplings on the conductive antenna element wherein an electrical distance between the feed coupling and the first reference voltage couplings is less than an electrical distance between the first and second reference voltage couplings and wherein an electrical distance between the feed coupling and the second reference voltage coupling is less than the electrical distance between the first and second reference voltage couplings.

16. A planar inverted F antenna according to claim 15 wherein the planar inverted F antenna is configured for operation at an operating frequency band and wherein a current null is present on the conductive antenna element between the feed coupling and at least one of the reference voltage couplings at the operating frequency band.

17. A planar inverted F antenna according to claim 16 wherein the operating frequency band is in the range of approximately 1700 MHz to 2500 MHz and wherein the current null is present between the feed coupling and at least one of the reference voltage couplings at the operating frequency band in the range of approximately 1700 MHz to 2500 MHz.

18. A planar inverted F antenna according to claim 16 wherein the operating frequency band comprises a high-frequency band, wherein the planar inverted F antenna is further configured for operation at a low-frequency band, wherein the current null is present at the high-frequency band, and wherein the current null is not present between the feed coupling and the at least one of the reference voltage couplings at the low-frequency band.

19. A planar inverted F antenna according to claim 18 wherein the high-frequency band is above 1700 MHz and wherein the low-frequency band is below 1100 MHz.

20. A planar inverted F-antenna according to claim 16 wherein the operating frequency band is above 1700 MHz and wherein the current null is present between the feed coupling and at least one of the reference voltage couplings at the operating frequency band above 1700 MHz.

21. A planar inverted F antenna according to claim 15 further comprising:

a printed circuit board including a reference voltage conductor and an antenna feed conductor, the first and second reference voltage couplings being electrically coupled to the reference voltage conductor of the printed circuit board, and the feed coupling being electrically coupled to the antenna feed conductor wherein the conductive antenna element is spaced apart from the printed circuit board.

22. A planar inverted F antenna according to claim 21 wherein at least one of the first and second reference voltage couplings is electrically coupled to the reference voltage conductor through an electrical short.

23. A planar inverted F antenna according to claim 21 wherein at least one of the first and second reference voltage coupling is electrically coupled to the reference voltage conductor through a non-zero impedance.

24. A planar inverted F antenna according to claim 15 wherein the feed coupling and at least one of the first and second reference voltage couplings are separated by an electrical distance of at least approximately 15 mm.

25. A planar inverted F antenna according to claim 15 wherein the conductive antenna element comprises, first and second antenna segments, wherein the first and second antenna segments are spaced apart, a third antenna segment coupled between the first and second antenna segments, and wherein the feed coupling and the first and second reference voltage couplings are on the first segment with the feed coupling being between the first and second reference voltage couplings.

26. A planar inverted F antenna according to claim 25 wherein the conductive antenna element further comprises a fourth antenna segment coupled to the first antenna segment.

27. A planar inverted F antenna according to claim 26 wherein the fourth antenna segment is coupled to the first antenna segment adjacent the feed coupling.

28. A planar inverted F antenna according to claim 15 wherein the feed coupling is spaced apart from at least one of the first and second reference voltage couplings by an electrical distance of at least approximately 10 mm.

29. A planar inverted F antenna according to claim 15 wherein the antenna element includes, an antenna base with the feed coupling and the first and second reference voltage couplings thereon, a first segment extending from the antenna base adjacent the first reference voltage coupling, and a second antenna segment extending from the antenna base adjacent the feed coupling.

30. A communications device comprising:

a transceiver configured to transmit and/or receive radio communications at an operating frequency band, the transceiver providing a reference voltage and a transceiver feed; and a planar inverted F antenna configured for operation at the operating frequency band, the planar inverted F antenna including first and second conductive antenna segments wherein the first and second conductive antenna segments are separated by at least approximately 3 mm, a third conductive antenna segment coupling the first and second conductive antenna segments, a reference voltage coupling on the first conductive antenna segment wherein the reference voltage coupling of the planar inverted F antenna is coupled to the reference voltage of the transceiver, and a feed coupling on the first conductive antenna segment wherein the feed coupling of the planar inverted F antenna is coupled to the transceiver feed and wherein a current null is present on the first conductive antenna segment between the feed and reference voltage couplings at the operating frequency band.

31. A communications device according to claim 30 wherein the feed and reference voltage couplings are separated by at least approximately 15 mm.

32. A communications device according to claim 30 wherein the first and second conductive antenna segments are rectilinear and parallel.

33. A communications device according to claim 32 wherein the third conductive antenna segment is coupled to the first and second conductive antenna segments at ends of the first and second conductive antenna segments.

34. A communications device according to claim 30 wherein the feed coupling is spaced apart from the third conductive antenna segment by a greater distance than the reference voltage coupling.

35. A communications device according to claim 34 wherein the first and the third conductive antenna segments define an angle of approximately 90 degrees.

36. A communications device according to claim 30 wherein the first conductive antenna segment is longer than the second conductive antenna segment.

37. A communications device according to claim 30 wherein the operating frequency band is in the range of approximately 1700 MHz to 2500 MHz and wherein the current null is present between the feed and reference voltage couplings at the operating frequency band in the range of approximately 1700 MHz to 2500 MHz.

38. A communications device according to claim 30 further comprising:

a printed circuit board including a reference voltage conductor and an antenna feed conductor, the reference voltage coupling being electrically coupled to the reference voltage conductor of the printed circuit board and the feed coupling being electrically coupled to the antenna feed conductor wherein the first, second, and third conductive antenna segments are spaced apart from the printed circuit board.

39. A communications device according to claim 38 wherein the reference voltage coupling is electrically coupled to the reference voltage conductor through an electrical short.

40. A communications device according to claim 38 wherein the reference voltage coupling is electrically coupled to the reference voltage conductor through a non-zero impedance.

41. A communications device according to claim 30 wherein the operating frequency band comprises a high-frequency band, wherein the planar inverted F antenna is further configured for operation at a low-frequency band, wherein the current null is present between the feed and reference voltage couplings at the high-frequency band, and wherein the current null is not present between the feed and reference voltage couplings at the low-frequency band.

42. A communications device according to claim 41 wherein the high-frequency band is above 1700 MHz and wherein the low-frequency band is below 1100 MHz.

43. A communications device according to claim 30 wherein the operating frequency band is above 1700 MHz and wherein the current null is present between the feed and reference voltage couplings at the operating frequency band above 1700 MHz.

44. A communications device comprising:

a transceiver configured to transmit and/or receive radio communications at an operating frequency band, the transceiver providing a reference voltage and a transceiver feed; and a planar inverted F antenna including a conductive antenna element, a feed coupling on the conductive antenna element wherein the feed coupling is coupled to the transceiver feed, and first and second reference voltage couplings on the conductive antenna element wherein the first and second reference voltage couplings are coupled to the reference voltage of the transceiver and wherein an electrical distance between the feed coupling and the first reference voltage couplings is less than an electrical distance between the first and second reference voltage couplings and wherein an electrical distance between the feed coupling and the second reference voltage coupling is less than the electrical distance between the first and second reference voltage couplings.

45. A communications device according to claim 44 wherein the planar inverted F antenna is configured for operation at an operating frequency band and wherein a current null is present on the conductive antenna element between the feed coupling and at least one of the reference voltage couplings at the operating frequency band.

46. A communications device according to claim 45 wherein the operating frequency band is in the range of approximately 1700 MHz to 2500 MHz and wherein the current null is present between the feed coupling and at least one of the reference voltage couplings at the operating frequency band in the range of approximately 1700 MHz to 2500 MHz.

47. A communications device according to claim 45 wherein the operating frequency band comprises a high-frequency band, wherein the planar inverted F antenna is further configured for operation at a low-frequency band, wherein the current null is present at the high-frequency band, and wherein the current null is not present between the feed coupling and the at least one of the reference voltage couplings at the low-frequency band.

48. A communications device according to claim 47 wherein the high-frequency band is above 1700 MHz and wherein the low-frequency band is below 1100 MHz.

49. A communications device according to claim 45 wherein the operating frequency band is above 1700 MHz and wherein the current null is present between the feed coupling and at least one of the reference voltage couplings at the operating frequency band above 1700 MHz.

50. A communications device according to claim 44 further comprising:

a printed circuit board including a reference voltage conductor and an antenna feed conductor, the first and second reference voltage couplings being electrically coupled to the reference voltage conductor of the printed circuit board, and the feed coupling being electrically coupled to the antenna feed conductor and wherein the conductive antenna element is spaced apart from the printed circuit board.

51. A communications device according to claim 50 wherein at least one of the first and second reference voltage couplings is electrically coupled to the reference voltage conductor through an electrical short.

52. A communications device according to claim 50 wherein at least one of the first and second reference voltage coupling is electrically coupled to the reference voltage conductor through a non-zero impedance.

53. A communications device according to claim 44 wherein the feed coupling and at least one of the first and second reference voltage couplings are separated by an electrical distance of at least approximately 15 mm.

54. A communications device according to claim 44 wherein the conductive antenna element comprises, first and second antenna segments, wherein the first and second antenna segments are spaced apart, a third antenna segment coupled between the first and second antenna segments, and wherein the feed coupling and the first and second reference voltage couplings are on the first segment with the feed coupling being between the first and second reference voltage couplings.

55. A communications device according to claim 54 wherein the conductive antenna element further comprises a fourth antenna segment coupled to the first antenna segment.

56. A communications device according to claim 55 wherein the fourth antenna segment is coupled to the first antenna segment adjacent the feed coupling.

57. A communications device according to claim 44 wherein the feed coupling is spaced apart from at least one of the first and second reference voltage couplings by an electrical distance of at least approximately 10 mm.

58. A communications device according to claim 44 wherein the antenna element includes, an antenna base with the feed coupling and the first and second reference voltage couplings thereon, a first segment extending from the antenna base adjacent the first reference voltage coupling, and a second antenna segment extending from the antenna base adjacent the feed coupling.

* * * * *